US006440631B1

(12) United States Patent
Kawamorita et al.

(10) Patent No.: US 6,440,631 B1
(45) Date of Patent: Aug. 27, 2002

(54) PROCESS FOR PRODUCING ELECTROPHOTOGRAPHIC PHOTOSENSITIVE MEMBER

(75) Inventors: Yoichi Kawamorita, Chigasaki; Takao Soma, Yamato, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/475,179

(22) Filed: Dec. 30, 1999

(30) Foreign Application Priority Data

Jan. 8, 1999 (JP) ..... 11-003406
Jan. 8, 1999 (JP) ..... 11-003407
Jan. 8, 1999 (JP) ..... 11-003408

(51) Int. Cl.[7] ..... G03G 5/06
(52) U.S. Cl. ..... 430/135; 430/127
(58) Field of Search ..... 430/132, 133, 430/134, 135, 59.5, 59.2, 56, 78, 127, 79

(56) References Cited

U.S. PATENT DOCUMENTS 4,975,352 A * 12/1990 Anayama et al. ..... 430/135
5,132,197 A * 7/1992 Iuchi et al. ..... 430/78
5,202,214 A 4/1993 Kawamorita et al. ..... 430/133
5,309,245 A 5/1994 Hayashi et al. ..... 358/296

FOREIGN PATENT DOCUMENTS

JP 4-337962 11/1992
JP 4-372955 12/1992
JP 7-289870 * 11/1995

OTHER PUBLICATIONS

Derwent Machine–Assisted Translation of JP 7–289870 (Pub Nov. 7, 1995).*
JPAB Abstract of JP07289870, Copyright 1995, JPO.*
Database WPI, Section Ch, Week 199602, Derwent Publ., AN 1996–015629, XP002134729 for JP 07–289870.
Database WPI, Section Ch, Week 199425, Derwent Publ., AN 1994–203110, XP002134730 for JP 06–138682.
Patent Abstract of Japan, vol. 12, No. 399 (P–775), Oct. 24, 1998, of JP 63–139355.
Patent Abstracts of Japan, vol. 15, No. 487 (–1286), Dec. 10, 1991, of JP 03–211559.
Patent Abstracts of Japan, vol. 15, No. 460 (P–1278), Nov. 21, 1991, of JP 03–196049.
Patent Abstracts of Japan, vol. 10, No. 247 (P–490), Aug. 26, 1986, of JP 61–075359.

* cited by examiner

*Primary Examiner*—Janis L. Dote
(74) *Attorney, Agent, or Firm*—Fitzpatrick, Cella, Harper & Scinto

(57) ABSTRACT

A process for producing an electrophotographic photosensitive member has a layer. The process has the step of forming the layer by the use of a dispersion obtained by ejecting a pressurized fluid from an orifice into a hollow member having a diameter larger than the diameter of the orifice, to disperse a material to be dispersed. The fluid is ejected in substantially an unatomized state.

17 Claims, 5 Drawing Sheets

PROCESS FOR PRODUCING ELECTROPHOTOGRAPHIC PHOTOSENSITIVE MEMBER

BACKGROUND OF THE INVENTION

1. Field of the Invention

This invention relates to a process for producing an electrophotographic photosensitive member.

2. Related Background Art

Electrophotographic photosensitive members making use of organic photoconductive materials have, e.g., a charge generation layer containing a charge-generating material and a surface protective layer containing a conductive material and a lubricant. These layers are formed by coating a dispersion prepared by dispersing the corresponding materials in a resin, followed by drying.

Dispersion means conventionally used to prepare such a dispersion include roll mills, ball mills, attritors, sand mills and high-pressure dispersion mixers. The roll mill dispersion is a method in which a fluid (liquid) mixture comprised of a pigment, a binder resin and a solvent is passed between two or more rotating rolls to carry out dispersion, but are not so widely used in recent years because of a disadvantage that they have a very poor productivity.

The dispersion carried out using ball mills, attritors or sand mills is a method in which a pigment, a binder resin, a solvent and so forth are put in a vessel (dispersion vessel) together with a medium (dispersion medium) and are stirred by some means to effect dispersion by the aid of energy produced by collision or friction between medium beads.

However, in the case of dispersions (fluid dispersions) for electrophotographic photosensitive members, dispersion must be effected especially microscopically and in a narrow particle size distribution. In these dispersion methods, it is difficult to obtain dispersions formed microscopically and in a narrow particle size distribution. These methods are also unsatisfactory in view of productivity. Also, fragments of the vessel and medium may become included in dispersions to damage the properties of electrophotographic photosensitive members. Electrophotographic photosensitive members obtained by production processes making use of such dispersions tends to cause spots (black spots or white spots) and image fog.

As a different dispersion method, as disclosed in Japanese Patent Application Laid-open Nos. 4-337962 and 4-372955, a high-pressure dispersion method is available in which a fluid mixture containing a pigment and a dispersion solvent is led into a dispersion chamber having an orifice, under application of a high pressure to cause the fluid to collide against one another at a high velocity in its channel leading to the orifice, to carry out dispersion.

In such a conventional high-pressure dispersion method, however, it is impossible to obtain dispersions formed well microscopically and in a narrow particle size distribution, and electrophotographic photosensitive members produced using such dispersions may cause spots and image fog in some cases.

In such conventional high-pressure dispersion, the dispersion chamber has a structure wherein a channel is provided therein with a branching zone and a joining zone to cause the fluid mixture to collide against one another (FIG. 6), or a structure wherein a channel is bent to provide a bent zone to cause the fluid mixture to collide against walls. (FIG. 7). Thus, since the fluid mixture undergoes dispersion in a microscopic time passing through a microscopic volume, the dispersion can not be effected well uniformly to tend to cause over-dispersion at some portions of the fluid mixture and insufficient dispersion at its other portions, and it is difficult to effect uniform dispersion. Accordingly, in some cases, the step of dispersion must be repeated plural times to ensure necessary properties, and it has been sought to more improve productivity.

In particular, a charge-generating material oxytitanium phthalocyanine tends to cause crystal transformation during the dispersion. Also, azo pigments and fluorine resin powders may agglomerate to make it impossible to achieve any good uniformity in some cases.

In addition, in the conventional high-pressure dispersion, the dispersion chamber may greatly wear at the branching zone, joining zone and bent zone of its channel to make dispersions have an unstable quality because of the wear of its channels. Moreover, such a dispersion chamber requires a high production cost and the dispersion machine requires a high maintenance cost. Furthermore, because of the branching zone, joining zone and bent zone present inside the dispersion chamber, it has been difficult to perform maintenance or disassembly cleaning.

SUMMARY OF THE INVENTION

An object of the present invention is to provide a process for producing an electrophotographic photosensitive member by which materials to be dispersed can be dispersed microscopically and in a narrow particle size distribution and can be dispersed in a good productivity and stably at a low cost.

Another object of the present invention is to provide a process for producing an electrophotographic photosensitive member which may hardly cause faulty images such as spots and image fog.

The present invention provides a process for producing an electrophotographic photosensitive member having a layer; the process comprising the step of forming the layer by the use of a dispersion obtained by ejecting a pressurized fluid from an orifice into a hollow member having a diameter larger than the diameter of the orifice, to disperse a material to be dispersed; the fluid being ejected in substantially an unatomized state.

DESCRIPTION OF THE PREFERRED EMBODIMENTS

The electrophotographic photosensitive member obtained by the process of the present invention has a layer formed by coating a dispersion (fluid dispersion) followed by drying, which is obtained by ejecting a pressurized fluid from an orifice into a hollow member having a diameter (inner diameter) larger than the diameter of the orifice, to disperse a material to be dispersed; the fluid being ejected in substantially an unatomized state.

In the present invention, dispersion is carried out first at the time the fluid passes through the orifice and is ejected into the hollow member. Also, in the present invention, the fluid having been ejected stands substantially not atomized, and is jetted into the hollow member in the state of a high-velocity jet stream. Hence, the dispersion is effected by the aid of a shear force acting between the fluid flowing into it and the fluid stagnating in the hollow member after it has flowed in. Thus, the dispersion can be effected well efficiently and in a narrow particle size distribution. The electrophotographic photosensitive member produced using the resultant fluid dispersion promises images free of faulty images such as spots and image fog.

In the present invention, the fluid can also be made to pass through an orifice in a dispersion chamber having a channel provided with neither the bent zone nor the joining zone. Hence, the channel may less wear, and the dispersion chamber can have a long life to enable stable manufacture over a long period of time. Moreover, since the dispersion chamber has neither the bent zone nor the joining zone in its channel, the dispersion machine can be disassembled and cleaned with ease, and arrangements can be made in a short time when the dispersion is carried out to prepare two or more types of fluid dispersions by using a single dispersion machine, promising a high production efficiency.

Figure 1:
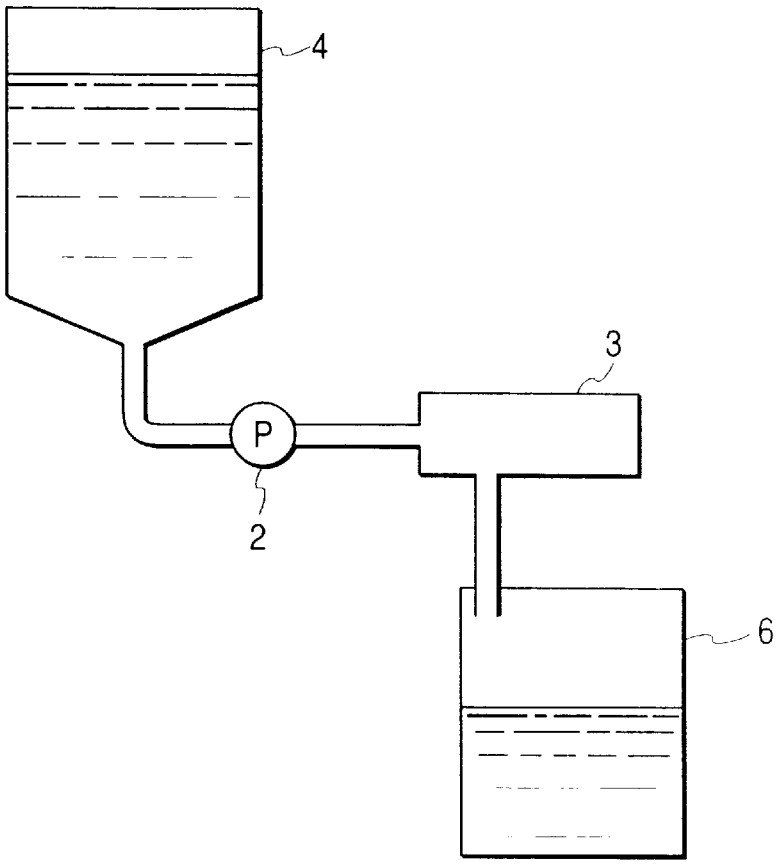
FIG. 1 is a schematic illustration of an example of the construction of a high-pressure jet dispersion machine used in the production process of the present invention.
Figure 3:
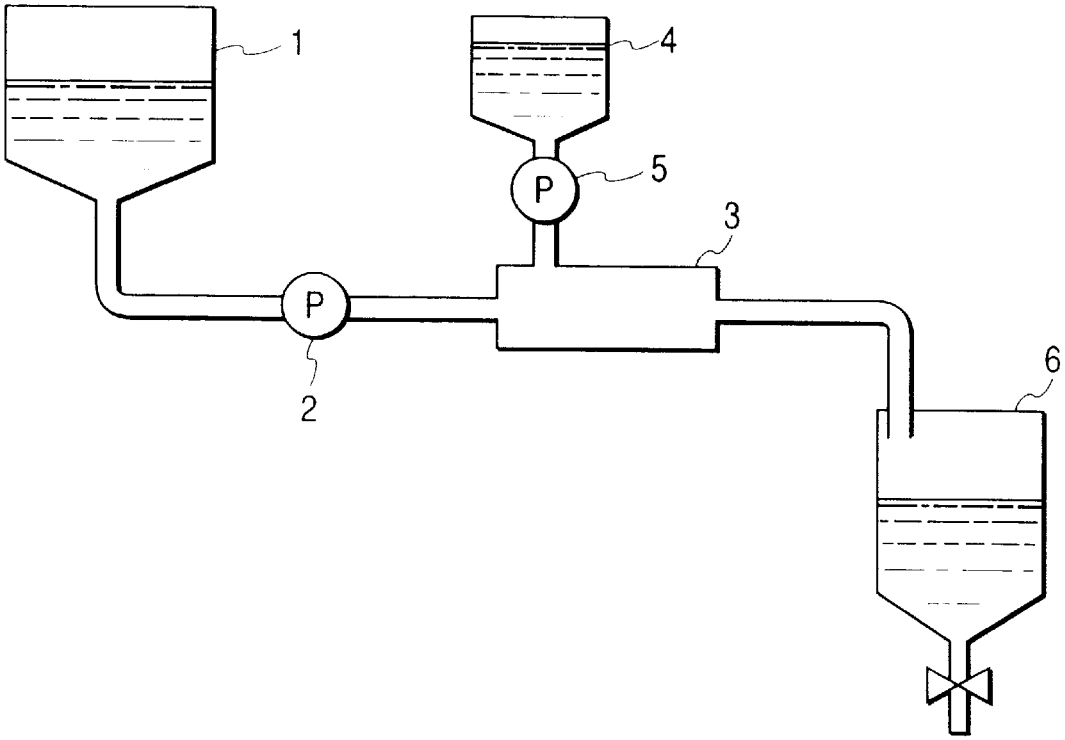
FIG. 3 is a schematic illustration of another example of the construction of a high-pressure jet dispersion machine used in the production process of the present invention.

Examples of the construction of an apparatus for producing fluid dispersions for electrophotographic photosensitive members are schematically shown in FIGS. 1 and 3.

In the apparatus shown in FIG. 1, a fluid (liquid) mixture is led from a fluid-mixture tank 4 to a dispersion chamber 3 by means of a high-pressure pump 2. The fluid dispersion having been prepared is led to a fluid-dispersion tank 6.

Figure 2:
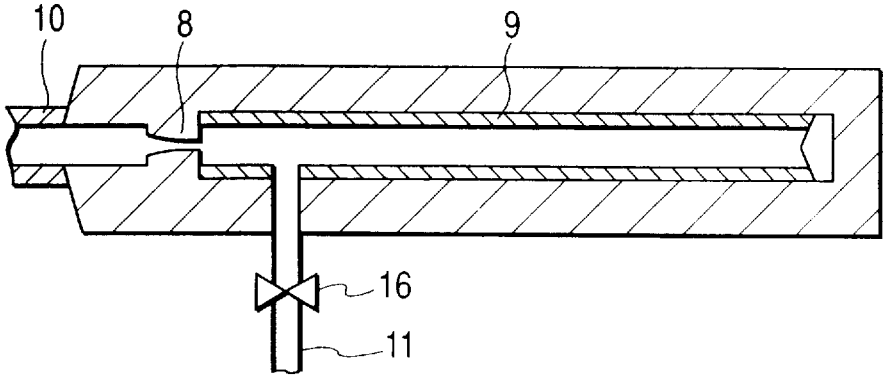
FIG. 2 is a schematic illustration of an example of the construction of a dispersion chamber in the high-pressure jet dispersion machine used in the production process of the present invention.

As an example of the construction of the dispersion chamber used in the present invention, it may include the one shown in FIG. 2. A high-pressure fluid mixture is introduced through a fluid-mixture inlet 10, and is made into a high-velocity jet stream through an orifice 8. This high-velocity jet stream is jetted into a hollow member 9. The fluid is discharged through a fluid-dispersion discharge outlet 11. Incidentally, a back-pressure valve 16 may be provided so that the effect of dispersion does not become low because of microscopic bubbles which may occur at the moment the fluid is discharged out of the dispersion chamber and the pressure lowers.

In the apparatus shown in FIG. 3, a dispersion solvent and so forth are led from a dispersion medium tank 1 to a dispersion chamber 3 by means of a high-pressure pump 2. Meanwhile, a fluid which contains the material to be dispersed such as a pigment is sent from a fluid-mixture tank 4 (tank B) by means of an injection pump 5, and led and injected into the dispersion chamber 3. The fluid dispersion having been prepared is led to a fluid-dispersion tank 6. In the structure of a dispersion chamber shown in FIG. 4, a high-pressure dispersion solvent is introduced through a solvent inlet 7, and is made into a high-velocity jet stream through an orifice 8. This high-velocity jet stream is jetted into a hollow member 9. Meanwhile, the fluid which contains the material to be dispersed such as a pigment is injected through a fluid-mixture inlet 10 to the high-velocity jet stream formed previously, to effect dispersion. The fluid dispersion having been prepared is discharged through a fluid-dispersion discharge outlet 11.

As the shape of a channel leading to the orifice in the dispersion chamber of the present invention, it may preferably be a shape causative of wear with difficulty because the high-velocity jet stream must be jetted into the hollow member. If the dispersion chamber has the joining zone or bent zone in its channel, the channel tends to wear at that part, resulting in a shortening of the life of the dispersion chamber. From this point of view, the channel leading to the orifice may preferably be substantially straight.

The jet stream in the orifice may preferably be at a velocity of from 40 to 3,000 m/sec, and particularly preferably from 200 to 2,000 m/sec, where good results can be obtained. The orifice diameter and the volume and pressure of the pump may appropriately be set in accordance with the necessary velocity of the jet stream.

The orifice may preferably have a diameter of from 0.01 to 1.0 mm, and particularly preferably from 0.05 to 0.3 mm. If it has a too small diameter, the productivity may not be improved and also the orifice tends to clog. If it has a too large diameter, although the productivity is improved, a pump having a volume enough for that size is required in order to ensure the necessary velocity of the jet stream, resulting in a high system cost.

The orifice may preferably be made of a material that may hardly wear when the fluid passes therethrough, including, e.g., diamonds such as sintered diamond and single-crystal diamond, ceramic materials such as alumina, zirconia and Carborundum, and metals such as stainless steel, iron and titanium.

In the present invention, the high-velocity jet stream narrowed at the orifice is jetted to carry out dispersion. Accordingly, it may preferably have such a structure that the high-velocity jet stream may slow down while undergoing the shearing action between the jet stream and the fluid with which the hollow member stands filled, and that it does not collide against the inner walls of the hollow member at a high velocity.

Figure 4:
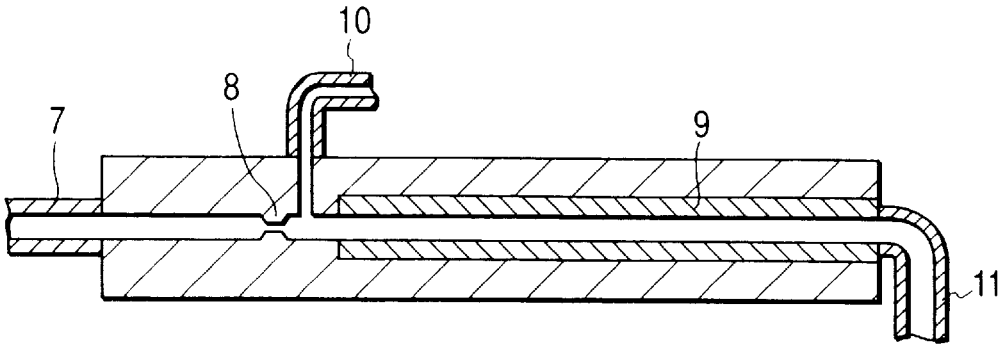
FIG. 4 is a schematic illustration of another example of the construction of a dispersion chamber in the high-pressure jet dispersion machine used in the production process of the present invention.

In the hollow member, the high-velocity jet stream jetted into it must be flowable at the necessary distance and linearly. As a preferred example of the shape of the hollow member, it may include cylindrical members as shown in FIGS. 2 and 4. The high-velocity jet stream narrowed at the orifice passes along the center of the cylinder without colliding against the wall surfaces and slows down while undergoing the shearing action between the jet stream and the fluid with which the hollow member has already been filled.

The hollow member must have a diameter (inner diameter) larger than the diameter of the orifice. If, however, it has a too large diameter, any uniform flow may not be formed in the hollow member to tend to make dispersion non-uniform. Stated specifically, the hollow member may preferably have a diameter twice to hundred (2 to 100) times the orifice diameter, and particularly preferably three to fifty (3 to 50) times and a diameter not larger than 10 mm. The hollow member must have a linear structure so that the high-velocity jet stream does not collide against the inner walls at a high velocity. Stated specifically, it may preferably have a length of from 30 to 300 mm.

The hollow member may preferably be made of a material that may hardly wear when the fluid dispersion passes, including, e.g., ceramic materials such as alumina, zirconia and Carborundum, and metals such as stainless steel, iron and titanium.

The hollow member must also have such a structure that the fluid dispersion formed can appropriately be discharged. The fluid dispersion may be discharged from any portions of the hollow member, depending on its purpose. For example, when a discharge outlet is provided at an end on the side opposite to the orifice, the fluid dispersion can be uniformly discharged by the aid of the pressure of the high-velocity jet stream jetted into the hollow member. Also, when it has such a structure that the fluid dispersion is discharged therefrom on the side of the orifice, the high-velocity jet stream flows along the center of the hollow member and the fluid dispersion having returned along the wall surfaces comes to flow in the counter direction to the high-velocity jet stream. Thus, the shearing can be made highly effective and also the fluid dispersion can be discharged uniformly. However, the hollow member must be so structured that the material to be dispersed, injected into it, is not discharged before it has been dispersed.

In the high-velocity jet dispersion in the present invention, the pressure at which the fluid mixture or solvent is brought to the orifice may appropriately be selected taking account of the material to be dispersed and dispersion conditions in combination. It may preferably be from $5\times10^3$ to $3.2\times10^5$ kPa, and particularly preferably from $2\times10^4$ to $3\times10^5$ kPa. If the pressure is too low, insufficient dispersion tends to result, and, if it is too high, over-dispersion.

In the high-velocity jet dispersion in the present invention, the dispersion cycle (the number of time in which the fluid mixture or solvent passes through the orifice) is once or more, which may appropriately be selected taking account of materials selected, dispersion conditions and properties required.

The pressure inside the hollow member (called back pressure) may further be controlled by means of the back-pressure valve to prevent dispersion power from decreasing because of microscopic bubbles which may occur when the pressure lowers abruptly after the fluid mixture or solvent passes through the orifice. The back pressure changes depending on dispersion conditions, boiling points of dispersion solvents and so forth. A back pressure of $1\times10^3$ kPa or below may be less effective. Even if it is made higher than $1\times10^4$ kPa, any corresponding higher effect is not obtainable, only resulting in a large load on the hollow member. Incidentally, a cooling means may also be provided in order to keep constant the temperature of the fluid discharged from the hollow member. As an example of the cooling means, a coiled pipe may be provided in cooling water and the fluid dispersion may be passed therethrough to effect heat exchange. Such a method may be used.

As an example of steps for producing the fluid dispersion according to the present invention, first the fluid mixture to be put to dispersion is prepared. The material to be dispersed such as a pigment is mixed in a solvent, and a binder resin is optionally further dissolved therein. In an instance where lumps of the material to be dispersed are included in the fluid mixture to clog the orifice of the dispersion machine, the lumps may be broken up by a suitable means. Such a means may include high-speed revolution type homogenizers and ultrasonic dispersion machines. Another method is also available in which only the material to be dispersed and the solvent are mixed first and the binder resin is dissolved after dispersion.

Next, this fluid mixture for dispersion is fed into a high-pressure jet dispersion machine. The fluid-mixture tank may be provided with a means for preventing sedimentation of the material to be dispersed. The fluid for which the dispersion has been completed is led to the fluid-dispersion tank and, after adjustment to a suitable concentration, used as a coating fluid.

As another example of steps for producing the fluid dispersion according to the present invention, first the dispersion solvent and so forth are put into the tank 1 shown in FIG. 3, and the fluid mixture containing the material to be dispersed and solvent are put into the tank 4. The fluid in the tank 1 (the fluid to be jetted from the orifice) may be a fluid that can pass through the orifice at a high velocity. It may also contain, in addition to at least the dispersion solvent, a binder resin and additives. The dispersion solvent may be either of a single solvent and a mixed solvent.

The fluid in the tank 4 (the fluid to be injected into the high-velocity jet stream) contains at least the material to be dispersed. When the fluid has a sufficient fluidity, it may contain only the material to be dispersed. Usually, it is used as a fluid mixture containing a solvent or the like in order to improve its fluidity. In an instance where lumps of the material to be dispersed are included in the fluid mixture to make any uniform injection unable or to clog the injection opening, the lumps may be broken up by a suitable means. Such a means may include high-speed revolution type homogenizers and ultrasonic dispersion machines. The fluid-mixture tank may be provided with a means for preventing sedimentation of the material to be dispersed. The fluid for which the dispersion has been completed is led to the fluid-dispersion tank and, after adjustment to a suitable concentration, used as a coating fluid.

The material to be dispersed, usable in the production process of the present invention may be any material. In particular, the present invention acts effectively on a phthalocyanine pigment, an azo pigment and a fluorine resin powder when used as the material to be dispersed.

As examples of the phthalocyanine pigment, it may include copper phthalocyanine pigments, metal-free phthalocyanine pigments, vanadium phthalocyanine pigments and oxytitanium phthalocyanine pigments. Phthalocyanine pigments of different types or a phthalocyanine pigment and a pigment of different type (including azo pigments, quinone pigments, quinocyanine pigments and perylene pigments) may also be used in the form of a mixture.

Of these pigments, the dispersion process of the present invention is effective for dispersing pigments whose crystal form tends to break down, as exemplified by oxytitanium phthalocyanine having a main peak at Bragg's angle ($2\theta\pm0.2°$) of 27.1° in CuKα characteristic X-ray diffraction, and oxytitanium phthalocyanine having strong peaks at Bragg's angles ($2\theta\pm0.2°$) of 9.0°, 14.2°, 23.9° and 27.1°.

The azo pigment may include those having an azo group in the molecule, as exemplified by diazo pigments and trisazo pigments. As examples of particularly effective azo pigments, those represented by the following formulas (1) to (6) are effective.

(1)
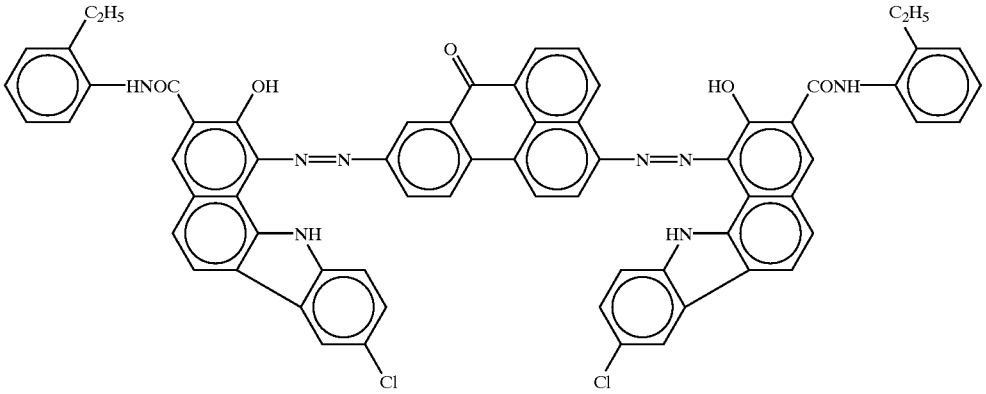
(2)
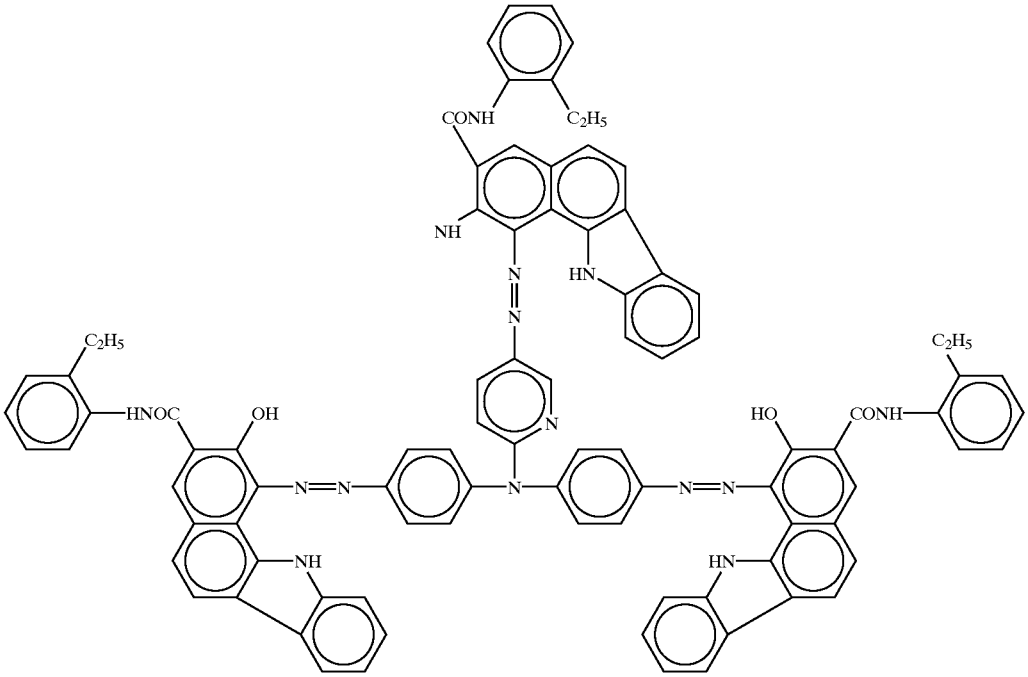
(3)
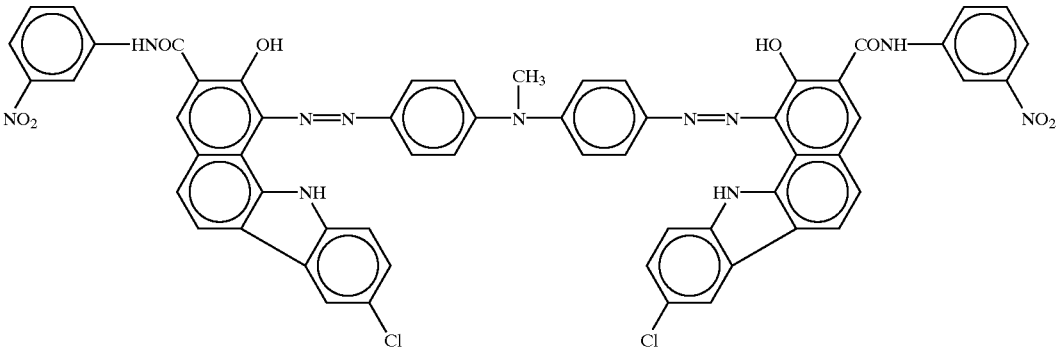

-continued
(4)
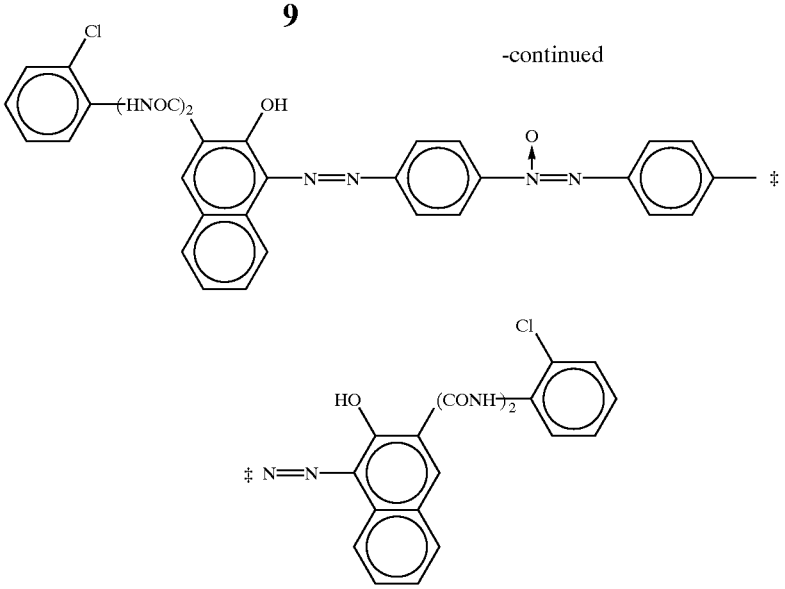
(5)
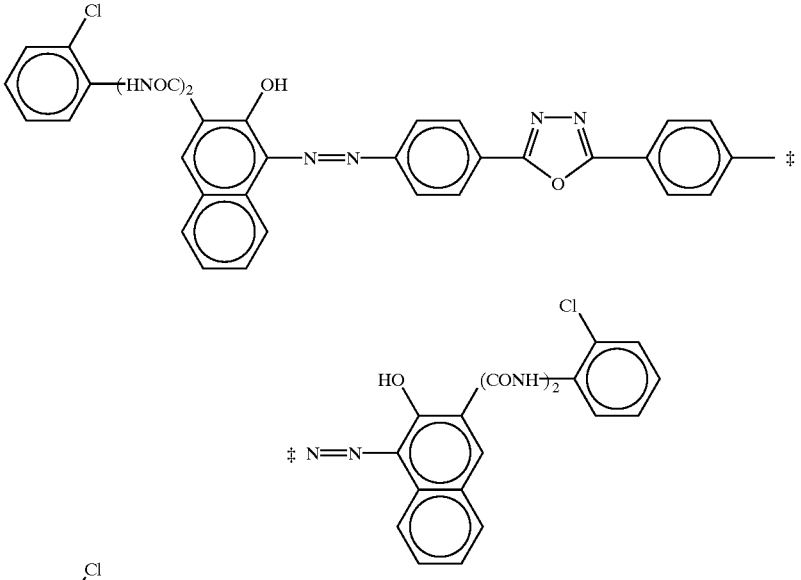
(6)
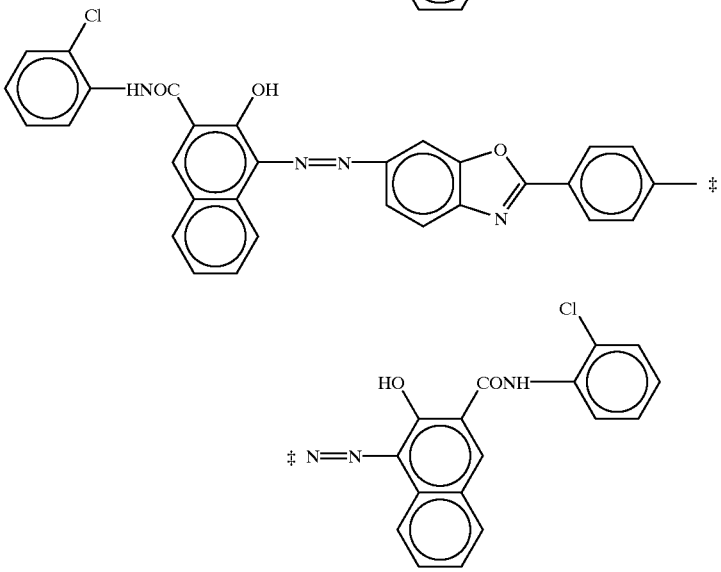

In the present invention, azo pigments of different types or an azo pigment and a pigment of different type (including, e.g., phthalocyanine pigments, quinone pigments, quinocyanine pigments and perylene pigments) may also be used in the form of a mixture.

The solvent usable in dispersing the above pigments in the present invention may include ether type solvents such as tetrahydrofuran and diethyl ether, ketone type solvents such as cyclohexanone and methyl ethyl ketone, ester type solvents such as ethyl acetate and butyl acetate, petroleum type solvents such as hexane and octane, alcohol type solvents such as methanol, ethanol and methoxypropanol, halogen type solvents such as monochlorobenzene and dichlorobenzene, and also water, any of which may be selected taking account of their solubility in binder resins, dispersibility for pigments and suitability for coating.

As examples of the binder resin usable in dispersing the above pigments in the present invention, it may include polyvinyl butyral resins, polyarylate resins, polycarbonate resins, polyester resins, acrylic resins, polyacrylamide resins, polyvinyl acetate resins, polyamide resins, cellulose resins, urethane resins, epoxy resins, casein, polyvinyl alcohol resins and benzal resins, any of which may be selected taking account of performances required as electrophotographic photosensitive members, dispersibility and so forth.

Materials suited to what is required for the performances of electrophotographic photosensitive members may further be added. Such additives may include, e.g., those for improving the performances of electrophotographic photosensitive members, such as donor materials, acceptor materials and antioxidants; and those for improving dispersibility and coating properties, such as dispersing agents and coating material modifiers (such as silicone oil, leveling agents and coupling agents).

As for the fluorine resin powder, preferred are tetrafluoroethylene resins, trifluoroethylene resins, hexafluoroethylene propylene resins, vinyl fluoride resins, vinylidene fluoride resins, and copolymer resins of any of these. These fluorine resin powders are commonly mixed with a suitable binder resin together with a solvent at the time of dispersion or after dispersion.

The solvent may include the same ones as those described previously.

As the binder resin usable here, it may include polycarbonate resins having a bisphenol-A skeleton, polycarbonate resins having a bisphenol-Z skeleton and other polycarbonate resins, and also acrylic resins, styrene resins, acrylate-styrene copolymer resins, polyester resins, polyurethane resins, polyarylate resins and polysulfone resins. Any of these resins may be used alone or in the form of a mixture of two or more types.

To a surface layer (when a protective layer is provided, the protective layer is the surface layer) of the photosensitive member to be obtained in the present invention, it is possible to add a photosensitive material or to add a dispersing agent or surface-active agent for dispersing lubricants, and additives such as a sensitizer and an antioxidant.

The photosensitive member obtained by the process of the present invention can contain the above fluorine resin powder in a uniformly dispersed state free of any agglomeration, up to an effective quantity. Hence, the surface layer can have proper surface slip properties, lubricity and wear resistance.

In the present invention, the fluorine resin powder may preferably be dispersed in the layer of the photosensitive member in an even and uniform state. Also, the fluorine resin powder has a greater effect corresponding to its quantity, where the degree of difficulty of such uniform dispersion is proportional to the quantity ratio of the fluorine resin powder. Thus, it is not easy to disperse the fluorine resin powder uniformly.

If agglomerates of the fluorine resin powder used as a lubricant come bare to the photosensitive member surface, a great difference in wear rate may be produced between such agglomerates and their neighborhood as electrical and physical stress is repeatedly applied to the photosensitive member, so that the agglomerates may grow to scratches which are so large as not to be imaginable from their initial size, tending to result in a great low image quality. Such agglomerates of a lubricant that may lead to scratches on the photosensitive member when used repeatedly are ruled by firstly the uniformity of average particle diameter in a disperse state and secondly the absolute size and probability of presence of coarse particles.

As a result of studies made by the present inventors, it has become clear that as a standard the fluorine resin powder may have an average particle diameter of 0.2 $\mu$m or smaller after dispersion treatment and also the probability of presence of coarse particles having particle diameters of 0.5 $\mu$m or larger may be 3% or less.

More specifically, if a system having an average particle diameter larger than 0.2 $\mu$m is used in the surface layer, images formed tend to be non-uniform on the whole. Also, the presence of coarse particles having particle diameters larger than 0.5 $\mu$m may bring nuclei of the scratches on the photosensitive member when used repeatedly. It is preferable for such coarse particles not to be present. In an experiment, however, difficulties on actual images were little seen as long as the probability of presence of the coarse particles was less than 5% inclusive of errors at the time of evaluation, and any scratches of photosensitive member caused by coarse particles were seen not to occur in every evaluation as long as it was 3% or less.

The electrophotographic photosensitive member obtained by the process of the present invention has a photosensitive layer on a support. As an example of configuration of the photosensitive layer, it may include a single-layer type photosensitive layer containing a charge-generating material and a charge-transporting material in the same layer, and a function-separated type photosensitive layer having a charge generation layer containing a charge-generating material and a charge transport layer containing a charge-transporting material. A protective layer for improving durability may further be provided on the photosensitive layer. The production process of the present invention is applicable to various fields relating to the production of electrophotographic photosensitive members. In particular, it is effective for forming a layer containing a charge-generating material, i.e., the single-layer type photosensitive layer, and the charge generation layer of the function-separated type photosensitive layer, and also a photosensitive layer and a protective layer which contain particles of the fluorine resin powder or the like.

As the support of the electrophotographic photosensitive member produced by the process of the present invention, it may include those made of materials having a conductivity, as exemplified by metals such as aluminum, an aluminum alloy, copper, nickel, iron and stainless steel, and resins endowed with a conductivity. As its shape, it may have the shape of, e.g., a drum or a sheet.

In order to control charge injection or to improve adhesion, the electrophotographic photosensitive member produced by the process of the present invention may also have a subbing layer between the support and the photosensitive layer. As a material for the subbing layer, it may include, e.g., polyvinyl butyral resins, polyarylate resins, polycarbonate resins, polyester resins, acrylic resins, polyacrylamide resins, polyvinyl acetate resins, polyamide resins, cellulose resins, urethane resins, epoxy resins, caseins, polyvinyl alcohol resins and benzal resins, any of which may be selected taking account of performances required as electrophotographic photosensitive members.

As the charge-generating material, it may include, e.g., phthalocyanine pigments, polycyclic quinone pigments, trisazo pigments, disazo pigments, monoazo pigments, perylene pigments, indigo pigments, quinacridone pigments, azulenium dyes, squarilium dyes, cyanine dyes, pyrylium dyes, thiopyrylium dyes, xanthene dyes, triphenylmethane dyes, styryl dyes, selenium, selenium-tellurium alloy, amorphous silicon and cadmium sulfide.

These charge-generating materials are commonly dispersed in a binder resin so as to be used as a coating material. Such a binder resin may preferably include polyvinyl butyral, polyvinyl benzal, polyarylates, polycarbonates, polyesters, polyurethanes, phenoxy resins, acrylic resins and cellulose resins.

The charge-transporting material may include, e.g., pyrene compounds, N-alkylcarbazole compounds, hydrazone compounds, N,N-dialkylaniline compounds, diphenylamine compounds, triphenylamine compounds, triphenylmethan compounds, pyrazoline compounds, styryl compounds, stilbene compounds, polynitro compounds and polycyano compounds.

These charge-transporting materials are commonly dissolved in a binder resin so as to be used as a coating material. Such a binder resin may include polycarbonates, polyesters, polyurethanes, polysulfone, polyamides, polyarylates, polyacrylamide, polyvinyl butyral, phenoxy resins, acrylic resins, acrylonitrile resins, methacrylic resins, phenolic resins, epoxy resins and alkyd resins.

As described previously, a protective layer may be provided on the photosensitive layer. As resins used in the protective layer may be the same as those used in the charge transport layer.

In the present invention, the surface layer of the electrophotographic photosensitive member may dispersedly be incorporated with a lubricant such as fluorine resin powder and conductive particles such as conductive metal oxide particles.

To form the above various layers, the coating fluids may be coated by a process including, e.g., dip coating, spray coating, spin coating, blade coating and roll coating.

Figure 10:
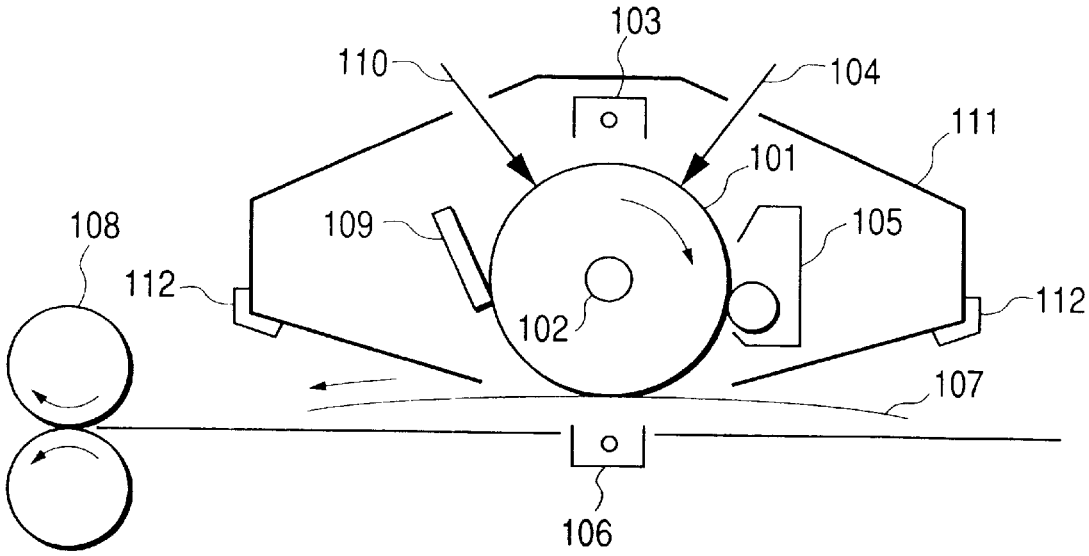
FIG. 10 schematically illustrates an example of the construction of an electrophotographic apparatus having a process cartridge having the electrophotographic photosensitive member of the present invention.

FIG. 10 schematically illustrates the construction of an electrophotographic apparatus having a process cartridge having the electrophotographic photosensitive member of the present invention. In FIG. 10, reference numeral 101 denotes a drum type electrophotographic photosensitive member of the present invention, which is rotatingly driven around an axis 102 in the direction of an arrow at a stated peripheral speed. The photosensitive member 101 is uniformly electrostatically charged on its periphery to a positive or negative, given potential through a primary charging means 103. The photosensitive member thus charged is then exposed to light 104 emitted from an exposure means (not shown) for slit exposure or laser beam scanning exposure. In this way, electrostatic latent images are successively formed on the periphery of the photosensitive member 101.

The electrostatic latent images thus formed are subsequently developed by toner by the operation of a developing means 105. The resulting toner-developed images are then successively transferred by the operation of a transfer means 106, to the surface of a transfer medium 107 fed from a paper feed section (not shown) to the part between the photosensitive member 101 and the transfer means 106 in the manner synchronized with the rotation of the photosensitive member 101.

The transfer medium 107 on which the images have been transferred is separated from the surface of the photosensitive member, is led through an image fixing means 108, where the images are fixed, and is then printed out of the apparatus as a copied material (a copy).

The surface of the photosensitive member 101 from which images have been transferred is brought to removal of the toner remaining after the transfer, through a cleaning means 109. Thus the photosensitive member is cleaned on its surface, further subjected to charge elimination by pre-exposure light 110 emitted from a pre-exposure means (not shown), and then repeatedly used for the formation of images. When the primary charging means 103 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 101, primary charging means 103, developing means 105 and cleaning means 109 so that the process cartridge is detachably mountable to the body of the electrophotographic apparatus such as a copying machine or a laser beam printer. For example, at least one of the primary charging means 103, the developing means 105 and the cleaning means 109 may be integrally supported in a cartridge together with the photosensitive member 101 to form a process cartridge 111 that is detachably mountable to the body of the apparatus through a guide means such as a rail 112 provided in the body of the apparatus.

In the case when the electrophotographic apparatus is a copying machine or a printer, the exposure light 104 is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member obtained by the process of the present invention is widely usable in electrophotographic machinery such as copying machines, laser beam printers and LED printers. It is also applicable to process cartridges for machinery where electrophotography is applied (those in which parts tending to wear in electrophotographic machinery are set integral so as to be exchangeable). The present invention will be described below in greater detail by giving Examples. In the following Examples, "part(s)" refers to "part(s) by weight".

EXAMPLE 1

In a mixed solvent of 220 parts of methanol and 60 parts of butanol, 20 parts of an alcohol-soluble copolymer nylon resin (average molecular weight: 29,000) and 20 parts of methoxymethylated nylon 6 (average molecular weight: 32,000) were dissolved to prepare a subbing layer coating solution. This coating solution was dip-coated on an aluminum cylinder (30 mm diameter and 260 mm long) serving as a support, followed by drying at 100° C. for 20 minutes to provide a subbing layer with a layer thickness of 1 $\mu$m.

Figure 8:
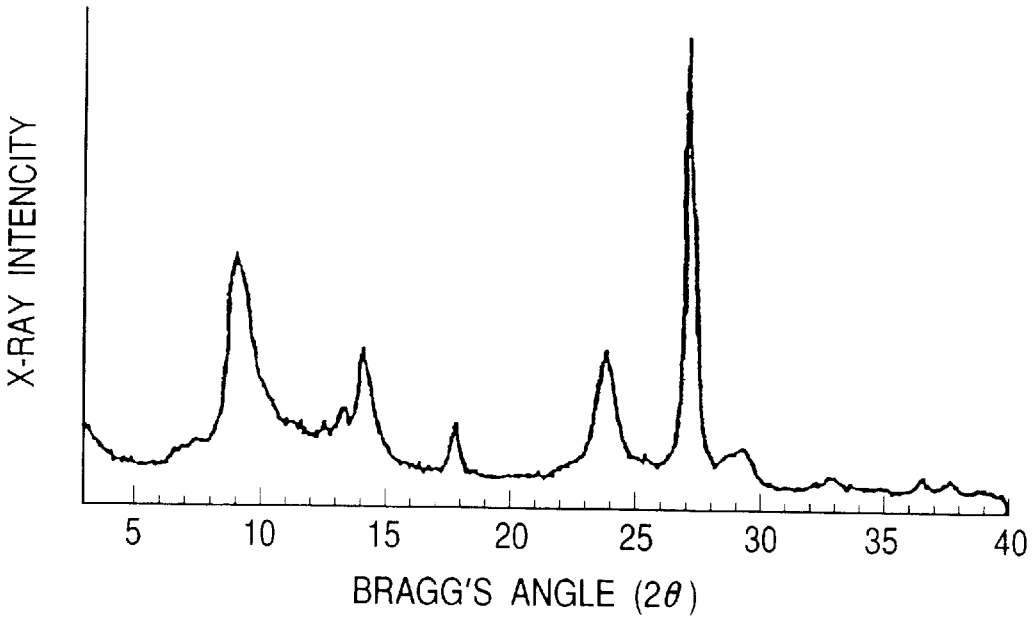
FIG. 8 is a CuKα characteristic X-ray diffraction pattern of an oxytitanium phthalocyanine before dispersion is carried out in Example 1 of the present invention.

Next, 1,000 parts of cyclohexanone was put into a stainless steel container, and 20 parts of polyvinyl butyral resin (trade name: S-LEC BX-1; available from Sekisui Chemical Co., Ltd.) was dissolved therein with stirring. Then, 30 parts of an oxytitanium phthalocyanine pigment (of a crystal type having strong peaks at Bragg's angles (2θ±0.2°) of 9.0°, 14.2°, 23.9° and 27.1° in CuKα characteristic X-ray diffraction, as shown in FIG. 8) was put into it, followed by mixing for 1 minute by means of a homogenizer (trade name: ULTRATALUX T-25; manufactured by Ika Laboratory).

The fluid mixture obtained was put in a high-pressure jet dispersion apparatus (DeBee 2000, manufactured by B.E.E. Co.) having the structure as shown in FIGS. 1 and 2, to carry out dispersion. Dispersion conditions were set as shown below.

Dispersion pressure: $1\times10^5$ kPa

Orifice diameter: 0.1 mm

Hollow member shape: 1 mm in diameter (cylindrical) 100 mm in length

Hollow member diameter/orifice diameter: 10

Back pressure: $2\times10^3$ kPa

Dispersion cycle: Once

Liquid flow rate: 640 m/sec

Volume average diameter of particles of the fluid dispersion thus obtained was measured with a centrifugal sedimentation type particle size distribution meter (CAPA 700, manufactured by Horiba Seisakusho). Results obtained are shown in Table 2.

Figure 9:
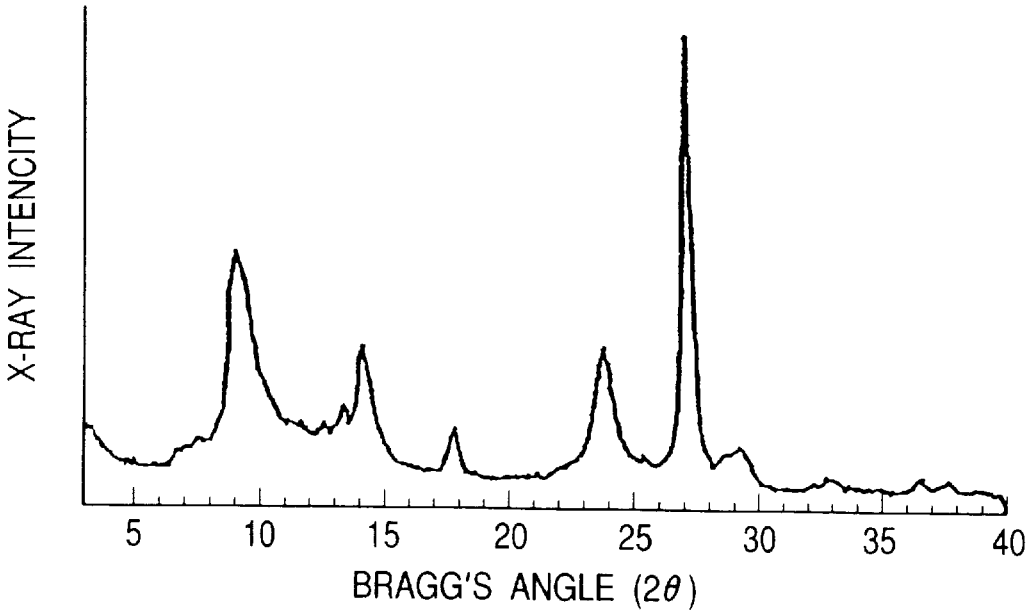
FIG. 9 is a CuKα characteristic X-ray diffraction pattern of the oxytitanium phthalocyanine after dispersion has been carried out in Example 1 of the present invention.

CuKα characteristic X-ray diffraction of the oxytitanium phthalocyanine pigment was also made after dispersion in order to compare its crystal form with that before dispersion. As the result, as shown in FIG. 9, no change was seen in its crystal form.

This fluid dispersion was diluted with ethyl acetate to have a solid content of 1.8% to prepare a charge generation layer coating fluid. On the lapse of 24 hours after the dispersion was completed, the coating fluid was dip-coated on the above subbing layer, followed by drying at 100° C. for 15 minutes to form a charge generation layer with a layer thickness of 0.15 μm.

Next, 100 parts of a triphenylamine compound represented by the formula:

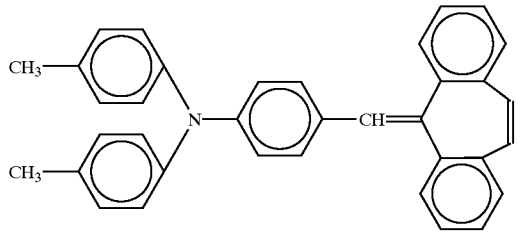

and 100 parts of polycarbonate resin (trade name: PANLITE L; available from Teijin Chemicals Ltd.; weight-average molecular weight: 20,000) were dissolved in a mixed solvent of 400 parts of monochlorobenzene and 200 parts of dichloromethane to prepare a charge transport layer coating solution. This solution was dip-coated on the charge generation layer, followed by drying at 130° C. for 30 minutes to form a charge transport layer with a layer thickness of 20 μm.

The electrophotographic photosensitive member thus produced was set in a reversal development type laser beam printer in which a process of charging, exposure, development, transfer and cleaning was repeated in a cycle of 1.5 seconds. To make image evaluation, 10,000 sheets of A4-size paper with printing percentage of 5% were fed into the printer and thereafter, in white solid images formed, the number of black spots (those with a diameter of 0.05 mm or larger and those with a diameter of 0.01 mm or larger) in images corresponding to the whole periphery of the photosensitive member was counted. Results obtained are shown in Table 2.

To make evaluation also on changes with time of the charge generation layer coating fluid prepared by dispersion, an electrophotographic photosensitive member was produced in the same manner but using the coating fluid after it was circulated for 50 days in an environment of 25° C. by means of a pump with a flow rate of 10 liters/minute. On white solid images at the initial stage (after the feeding of 10 sheets of A4-size paper), fog was examined and the number of black spots (those with a diameter of 0.05 mm or larger) in images corresponding to the whole periphery of the photosensitive member was counted. Results obtained are shown in Table 2.

EXAMPLES 2 TO 11

Charge generation layer fluid dispersions (coating fluids) were prepared in the same manner as in Example 1 except that the conditions for dispersion carried out using the high-pressure jet dispersion apparatus were changed as shown in Table 1.

Average diameter of particles of each fluid dispersion thus obtained was measured in the same manner as in Example 1 to make evaluation. Results obtained are shown in Table 2.

Electrophotographic photosensitive members were also produced in the same manner as in Example 1 except for using this fluid dispersion. Evaluation was made similarly. Results obtained are shown in Table 2.

EXAMPLE 12

In Example 1 the manner of preparing the charge generation layer coating fluid was changed as shown below.

1,000 parts of toluene was put into a stainless steel container, and 30 parts of methyl methacrylate resin (available from Mitsubishi Rayon Co., Ltd.; molecular weight: 145,000) was dissolved therein with stirring. Then, 40 parts of a copper phthalocyanine pigment was put into it, followed by mixing for 10 minutes by means of a homogenizer (trade name: ULTRATALUX T-25; manufactured by Ika Laboratory).

The fluid mixture obtained was put in the same high-pressure jet dispersion apparatus as that in Example 1 to carry out dispersion under the same conditions as those in Example 1.

Average diameter of particles of the fluid dispersion thus obtained was measured in the same manner as in Example 1 to make evaluation. Results obtained are shown in Table 2.

This fluid dispersion was diluted by toluene, and the dispersion with a solid content of 1.8% was dip-coated on a subbing layer formed in the same manner as in Example 1, followed by drying at 80° C. for 15 minutes to form a charge generation layer with a layer thickness of 0.25 μm.

Next, 80 parts of a hydrazone compound represented by the formula:

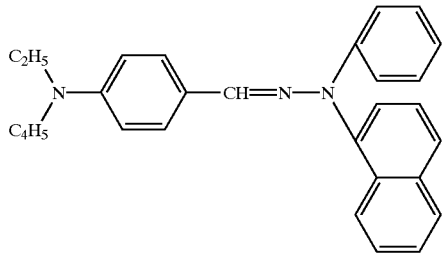

and 100 parts of styrene-methyl methacrylate copolymer resin (trade name: ESTYRENE; available from Shin Nittetsu Kagaku K. K.) were dissolved in a mixed solvent of 400 parts of monochlorobenzene and 200 parts of dichloromethane to prepare a charge transport layer coating solution. This solution was dip-coated on the charge generation layer, followed by drying at 110° C. for 30 minutes to form a charge transport layer with a layer thickness of 20 μm.

The electrophotographic photosensitive member thus produced was set in a reversal development type laser beam printer in which a process of charging, exposure, development, transfer and cleaning was repeated in a cycle of 2.5 seconds. To make image evaluation, 10,000 sheets of A4-size paper were fed into the printer and thereafter, in white solid images formed, the number of black spots (those with a diameter of 0.05 mm or larger and those with a diameter of 0.01 mm or larger) in images corresponding to the whole periphery of the photosensitive member was counted. Results obtained are shown in Table 2.

To make evaluation also on changes with time of the charge generation layer coating fluid prepared by dispersion, an electrophotographic photosensitive member was produced in the same manner but using the coating fluid after it was circulated for 50 days in an environment of 25° C. by means of a pump with a flow rate of 10 liters/minute. On white solid images at the initial stage (after the feeding of 10 sheets of A4-size paper), fog was examined and the number of black spots (those with a diameter of 0.05 mm or larger) in images corresponding to the whole periphery of the photosensitive member was counted. Results obtained are shown in Table 2.

EXAMPLE 13

In Example 1 the manner of preparing the charge generation layer coating fluid was changed as shown below.

1,000 parts of cyclohexanone was put into a stainless steel container, and 25 parts of polyvinyl butyral resin (trade name: S-LEC BX-1; available from Sekisui Chemical Co., Ltd.) was dissolved therein with stirring. Then, 40 parts of an oxytitanium phthalocyanine pigment (having strong peaks at Bragg's angles (2θ±0.2°) of 9.0°, 14.2°, 23.9° and 27.1° in CuKα characteristic X-ray diffraction, as shown in FIG. 8) and 10 parts of an azo pigment represented by the formula:

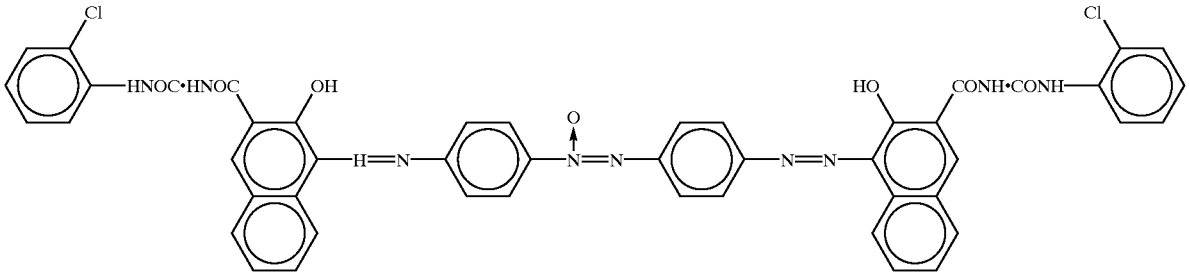

were put into it, followed by mixing for 3 minutes at 10,000 rpm by means of a homogenizer (trade name: ULTRATALUX T-25; manufactured by Ika Laboratory).

The fluid mixture obtained was put in the same high-pressure jet dispersion apparatus as that in Example 1 to carry out dispersion under the same conditions as those in Example 1. To the resultant fluid dispersion, 25 parts of polyvinyl butyral resin (trade name: S-LEC BX-1; available from Sekisui Chemical Co., Ltd.) was dissolved therein with stirring.

Average diameter of particles of the fluid dispersion thus obtained was measured in the same manner as in Example 1 to make evaluation. Results obtained are shown in Table 2.

Electrophotographic photosensitive members were also produced in the same manner as in Example 1 except for using this fluid dispersion. Evaluation was made similarly. Results obtained are shown in Table 2.

EXAMPLE 14

The coating fluid prepared in Example 1 was put to further dispersion and the dispersion machine was worked over a period of 1,000 hours under the same conditions as in Example 1. Thereafter, average diameter of particles of the fluid dispersion thus obtained was measured in the same manner as in Example 1 to make evaluation. As the result, the average particle diameter was 0.13 μm and its standard deviation was 0.10 μm.

Electrophotographic photosensitive members were also produced in the same manner as in Example 1 except for using this fluid dispersion. Evaluation was made similarly. As the result, good images were obtainable using the photosensitive members produced by using the coating fluid on the lapse of 24 hours after dispersion and also using the coating fluid after storage for 50 days at 25° C. Also, the dispersion apparatus was disassembled and the orifice diameter was measured, where there was no change in the orifice diameter even after the dispersion carried out for 1,000 hours.

COMPARATIVE EXAMPLES 1 TO 5

In Example 1 the manner of preparing the charge generation layer coating fluid was changed as shown below.

Figure 6:
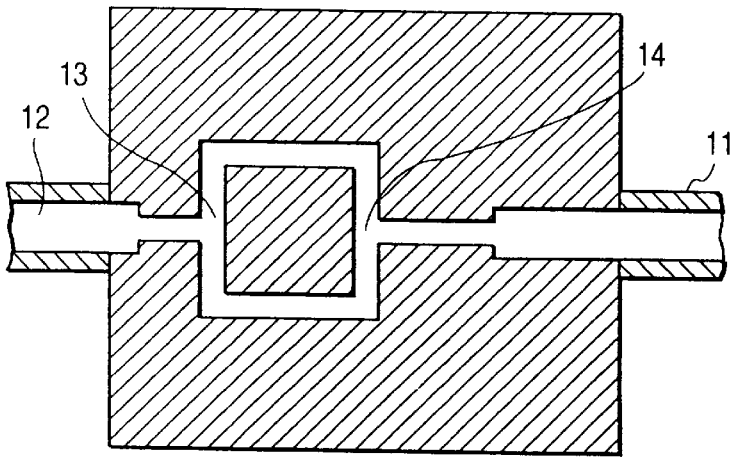
FIG. 6 PRIOR ART
FIG. 6 is a schematic illustration of an example of the construction of a conventional dispersion chamber having a channel provided with a branching zone and a joining zone.

The fluid mixture was put to dispersion using a high-pressure dispersion apparatus having the same system construction as that of Example 1 (the one shown in FIG. 1) except that the dispersion chamber has the structure wherein the channel is provided with a branching zone and a joining zone as shown in FIG. 6. Dispersion conditions were set as shown in Table 1 as Comparative Examples 1 to 5.

Average diameter of particles of the fluid dispersion thus obtained was measured in the same manner as in Example 1 to make evaluation. Results obtained are shown in Table 2.

Electrophotographic photosensitive members were also produced in the same manner as in Example 1 except for using this fluid dispersion. Evaluation was made similarly. Results obtained are shown in Table 2.

COMPARATIVE EXAMPLES 6 TO 8

In Example 1 the manner of preparing the charge generation layer coating fluid was changed as shown below.

Figure 7:
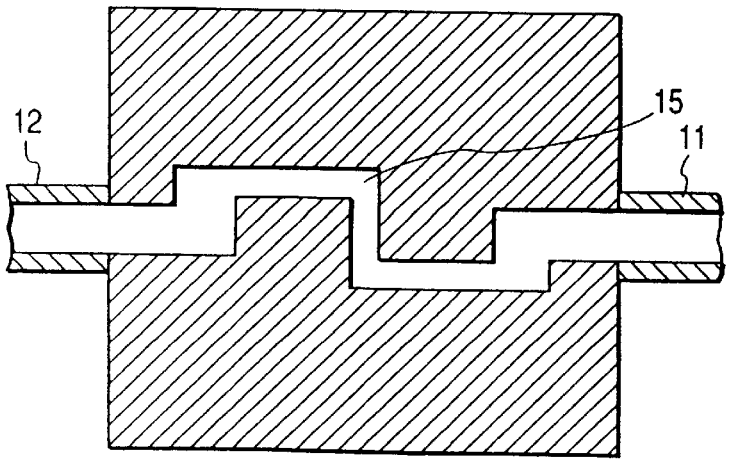
FIG. 7 PRIOR ART
FIG. 7 is a schematic illustration of an example of the construction of a conventional dispersion chamber having a channel provided with a bent zone.

The fluid mixture was put to dispersion using a high-pressure dispersion apparatus having the same system construction as that of Example 1 (the one shown in FIG. 1) except that the dispersion chamber has the structure wherein the channel is provided with a bent zone as shown in FIG. 7. Dispersion conditions were set as shown in Table 1 as Comparative Examples 6 to 8.

Average diameter of particles of the fluid dispersion thus obtained was measured in the same manner as in Example 1 to make evaluation. Results obtained are shown in Table 2.

Electrophotographic photosensitive members were also produced in the same manner as in Example 1 except for using this fluid dispersion. Evaluation was made similarly. Results obtained are shown in Table 2.

COMPARATIVE EXAMPLE 9

A charge generation layer coating fluid was prepared in the same manner as in Example 12 except that dispersion was carried out using the high-pressure dispersion apparatus of Comparative Example 1 and under the same conditions as in Comparative Example 5 to obtain a fluid dispersion.

Average diameter of particles of the fluid dispersion thus obtained was measured in the same manner as in Example 1 to make evaluation. Results obtained are shown in Table 2.

Electrophotographic photosensitive members were also produced in the same manner as in Example 12 except for using this fluid dispersion. Evaluation was made similarly. Results obtained are shown in Table 2.

COMPARATIVE EXAMPLE 10

A charge generation layer coating fluid was prepared in the same manner as in Example 13 except that dispersion was carried out using the high-pressure dispersion apparatus of Comparative Example 1 and under the same conditions as in Comparative Example 5 to obtain a fluid dispersion.

Average diameter of particles of the fluid dispersion thus obtained was measured in the same manner as in Example 1 to make evaluation. Results obtained are shown in Table 2.

Electrophotographic photosensitive members were also produced in the same manner as in Example 13 except for using this fluid dispersion. Evaluation was made similarly. Results obtained are shown in Table 2.

COMPARATIVE EXAMPLE 11

The coating fluid prepared in Comparative Example 5 was put to further dispersion, and the dispersion machine was worked over a period of 1,000 hours under the same conditions as in Comparative Example 5. Thereafter, average diameter of particles of the fluid dispersion thus obtained was measured in the same manner as in Example 1. As the result, the average particle diameter was 0.19 $\mu$m and its standard deviation was 0.20 $\mu$m.

Electrophotographic photosensitive members were also produced in the same manner as in Example 1 except for using this fluid dispersion. Evaluation was made similarly. As the result, spots and fog were seen and good images were not obtainable even with use of the photosensitive member produced by using the coating fluid on the lapse of 24 hours after dispersion. Also, the dispersion apparatus was disassembled, where the channel was seen to have worn at its joining zone.

COMPARATIVE EXAMPLE 12

The coating fluid prepared in Comparative Example 8 was put to further dispersion, and the dispersion machine was worked over a period of 1,000 hours under the same conditions as in Comparative Example 8. Thereafter, average diameter of particles of the fluid dispersion thus obtained was measured in the same manner as in Example 1 to make evaluation. As the result, the average particle diameter was 0.20 $\mu$m and its standard deviation was 0.21 $\mu$m.

Electrophotographic photosensitive members were also produced in the same manner as in Example 1 except for using this fluid dispersion. Evaluation was made similarly. As the result, spots and fog were seen and good images were not obtainable even with use of the photosensitive member produced by using the coating fluid on the lapse of 24 hours after dispersion. Also, the dispersion apparatus was disassembled, where the channel was seen to have worn at its joining zone.

To summarize the results in Examples and Comparative Examples, as in Comparative Examples 1 to 10 the electrophotographic photosensitive members are produced using the coating fluid obtained by the dispersion process in which a high pressure is applied to the fluid mixture containing a pigment to cause it to pass through the channel having a branching zone and a joining zone or having a bent zone. In such cases, good images are not obtainable when the coating fluid is obtained by one-cycle dispersion, and spots tend to occur especially when the electrophotographic photosensitive member has become worn. The electrophotographic photosensitive members produced using the coating fluid obtained by dispersion repeated several times provided good images, but the stability was insufficient when the fluid dispersion was circulated. Moreover, as a result of long-time dispersion as in Comparative Examples 11 and 12, the channel becomes worn at its joining zone or bent zone.

On the other hand, as in Examples 1 to 13, according to the dispersion process of the present invention, coating fluids which can produce electrophotographic photosensitive members free of faulty images such as spots and image fog can be obtained by one-cycle dispersion, and the resultant electrophotographic photosensitive members can form well good images even after the charge transport layer has worn as a result of repeated use. Moreover, a good manufacture efficiency can be achieved and also the fluid dispersions have a good storage stability. Also, as in Example 14, the orifice may hardly wear to enable stable manufacture and also promise low-cost maintenance.

EXAMPLE 15

In a mixed solvent of 220 parts of methanol and 60 parts of butanol, 20 parts of an alcohol-soluble copolymer nylon resin (average molecular weight: 29,000) and 20 parts of methoxymethylated nylon 6 (average molecular weight: 32,000) were dissolved to prepare a subbing layer coating solution. This coating solution was dip-coated on an aluminum cylinder (30 mm diameter and 260 mm long) serving as a support, followed by drying at 100° C. for 20 minutes to provide a subbing layer with a layer thickness of 0.9 $\mu$m.

Next, 300 parts of cyclohexanone and 700 parts of tetrahydrofuran were put into a stainless steel container, and 20 parts of polyvinyl benzal resin (number-average molecular weight: 80,000; available from Kopia K.K.) was further dissolved therein with stirring. Then, 25 parts of the azo pigment represented by the formula (1) and 15 parts of the azo pigment represented by the formula (2) were put into it, followed by mixing for 1 minute by means of a homogenizer (trade name: ULTRATALUX T-25; manufactured by Ika Laboratory).

The fluid mixture obtained was put in a high-pressure jet dispersion apparatus (DeBee 2000, manufactured by B.E.E. Co.) having the structure as shown in FIGS. 1 and 2, to carry out dispersion. Dispersion conditions were set as shown below.

Dispersion pressure: $1\times10^5$ kPa

Orifice diameter: 0.1 mm

Hollow member shape: 1 mm in diameter (cylindrical) 100 mm in length

Hollow member diameter/orifice diameter: 10

Back pressure: 0 kPa

Dispersion cycle: Once

Liquid flow rate: 640 m/sec

Volume average diameter of particles of the fluid dispersion thus obtained was measured with a centrifugal sedimentation type particle size distribution meter (CAPA 700, manufactured by Horiba Seisakusho) to make evaluation. Results obtained are shown in Table 3.

This fluid dispersion was diluted with cyclohexanone to have a solid content of 1.8% to prepare a charge generation layer coating fluid. On the lapse of 24 hours after the dispersion was completed, the coating fluid was dip-coated on the above subbing layer, followed by drying at 100° C. for 15 minutes to form a charge generation layer with a layer thickness of 0.20 $\mu$m.

Next, 100 parts of a triphenylamine compound represented by the formula:

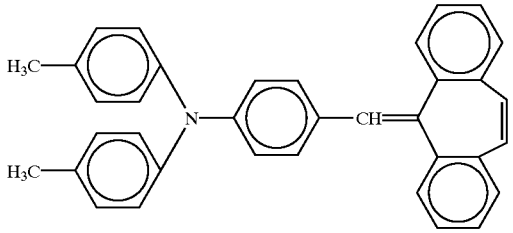

and 100 parts of polycarbonate resin (trade name: PANLITE L; available from Teijin Chemicals Ltd.; weight-average molecular weight: 40,000) were dissolved in a mixed solvent of 400 parts of monochlorobenzene and 200 parts of dichloromethane to prepare a charge transport layer coating solution. This solution was dip-coated on the charge generation layer, followed by drying at 130° C. for 30 minutes to form a charge transport layer with a layer thickness of 15 $\mu$m.

The electrophotographic photosensitive member thus produced was set in a reversal development type laser beam printer in which a process of charging, exposure, development, transfer and cleaning was repeated in a cycle of 1.5 seconds. To make image evaluation, 1000 sheets of A4-size paper with printing percentage of 5% were fed into the printer and thereafter the number of black spots (those with a diameter of 0.01 mm or larger) in white solid images corresponding to the whole periphery of the photosensitive member was counted. Results obtained are shown in Table 3.

EXAMPLES 16 TO 25

Charge generation layer fluid dispersions (coating fluids) were prepared in the same manner as in Example 15 except that the conditions for dispersion carried out using the high-pressure jet dispersion apparatus were changed as shown in Table 3.

Average diameter of particles of each fluid dispersion thus obtained was measured in the same manner as in Example 15 to make evaluation. Results obtained are shown in Table 3.

Electrophotographic photosensitive members were also produced in the same manner as in Example 15 except for using this fluid dispersion. Evaluation was made similarly. Results obtained are shown in Table 3.

EXAMPLE 26

In Example 15 the manner of preparing the charge generation layer coating fluid was changed as shown below.

500 parts of cyclohexanone and 500 parts of tetrahydrofuran were put into a stainless steel container, and 20 parts of polyvinyl butyral resin (trade name: S-LEC BLS; available from Sekisui Chemical Co., Ltd.) was dissolved therein with stirring. Then, 40 parts of the azo pigment represented by the formula (2) was put into it, followed by mixing for 3 minutes by means of a homogenizer (trade name: ULTRATALUX T-25; manufactured by Ika Laboratory).

The fluid mixture obtained was put in the same high-pressure jet dispersion apparatus as that in Example 15 to carry out dispersion under the conditions shown in Table 3.

Average diameter of particles of the fluid dispersion thus obtained was measured in the same manner as in Example 15 to make evaluation. Results obtained are shown in Table 3.

This fluid dispersion was diluted with tetrahydrofuran to have a solid content of 1.8% to prepare a charge generation layer coating fluid. This coating fluid was dip-coated on a subbing layer formed in the same manner as in Example 15, followed by drying at 80° C. for 15 minutes to form a charge generation layer with a layer thickness of 0.25 μm.

A charge transport layer was further formed in the same manner as in Example 15, thus an electrophotographic photosensitive member was produced. Evaluation was made similarly. Results obtained are shown in Table 3.

EXAMPLE 27

In Example 15 the manner of preparing the charge generation layer coating fluid was changed as shown below.

500 parts of cyclohexanone and 500 parts of tetrahydrofuran were put into a stainless steel container, and 20 parts of polyvinyl benzal resin (number-average molecular weight: 80,000; available from Kopia K.K.) was further dissolved therein with stirring. Then, 40 parts of the azo pigment represented by the formula (1) was put into it, followed by mixing for 5 minutes by means of a homogenizer (trade name: ULTRATALUX T-25; manufactured by Ika Laboratory).

The fluid mixture obtained was put in the same high-pressure jet dispersion apparatus as that in Example 15 to carry out dispersion under the conditions as shown in Table 3.

Average diameter of particles of the fluid dispersion thus obtained was measured in the same manner as in Example 15 to make evaluation. Results obtained are shown in Table 3.

This fluid dispersion was diluted with cyclohexanone to have a solid content of 1.6% to prepare a charge generation layer coating fluid. This coating fluid was dip-coated on a subbing layer formed in the same manner as in Example 15, followed by drying at 85° C. for 10 minutes to form a charge generation layer with a layer thickness of 0.25 μm.

A charge transport layer was further formed in the same manner as in Example 15, thus an electrophotographic photosensitive member was produced. Evaluation was made similarly. Results obtained are shown in Table 3.

EXAMPLE 28

In Example 15 the manner of preparing the charge generation layer coating fluid and charge transport layer coating solution was changed as shown below.

1,000 parts of cyclohexanone was put into a stainless steel container, and 20 parts of methyl methacrylate resin (number-average molecular weight: 100,000) was dissolved therein with stirring. Then, 50 parts of the azo pigment represented by the formula (3) was put into it, followed by mixing for 10 minutes by means of a homogenizer (trade name: ULTRATALUX T-25; manufactured by Ika Laboratory).

The fluid mixture obtained was put in the same high-pressure jet dispersion apparatus as that in Example 15 to carry out dispersion under the conditions as shown in Table 3. Average diameter of particles of the fluid dispersion thus obtained was measured in the same manner as in Example 15. Results obtained are shown in Table 3.

This fluid dispersion was diluted with tetrahydrofuran to have a solid content of 1.6% to prepare a charge generation layer coating fluid. This coating fluid was dip-coated on a subbing layer formed in the same manner as in Example 15, followed by drying at 80° C. for 15 minutes to form a charge generation layer with a layer thickness of 0.20 μm.

Next, 80 parts of a hydrazone compound represented by the formula:

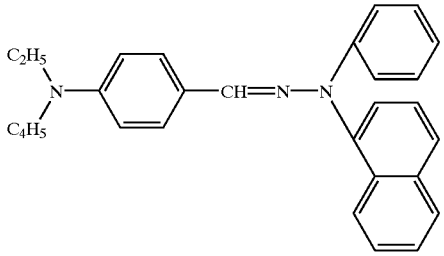

and 100 parts of styrene-methyl methacrylate copolymer resin (trade name: ESTYRENE; available from Shin Nittetsu Kagaku K.K.) were dissolved in a mixed solvent of 400 parts of monochlorobenzene and 200 parts of dichloromethane to prepare a charge transport layer coating solution. This solution was dip-coated on the charge generation layer, followed by drying at 110° C. for 60 minutes to form a charge transport layer with a layer thickness of 15 μm.

The electrophotographic photosensitive member thus produced was set in a reversal development type laser beam printer in which a process of charging, exposure, development, transfer and cleaning was repeated in a cycle of 5.0 seconds. To make image evaluation, the number of black spots (those with a diameter of 0.01 mm or larger) in white solid images corresponding to the whole periphery of the photosensitive member was counted. Results obtained are shown in Table 3.

EXAMPLE 29

The coating fluid prepared in Example 15 was put to further dispersion, and the dispersion machine was worked over a period of 1,000 hours under the same conditions as in Example 15. Thereafter, average diameter of particles of the fluid dispersion thus obtained was measured in the same manner as in Example 1 to make evaluation. As the result, the average particle diameter was 0.11 μm and its standard deviation was 0.10 μm.

An electrophotographic photosensitive member was also produced in the same manner as in Example 15 except for using this fluid dispersion. Evaluation was made similarly. As the result, good images were obtainable. Also, the dispersion apparatus was disassembled and the orifice diameter was measured, where there was no change due to wear or the like.

COMPARATIVE EXAMPLES 13 TO 17

In Example 15 the manner of preparing the charge generation layer coating fluid was changed as shown below.

The fluid mixture was put to dispersion using a high-pressure dispersion apparatus having the same system construction as that of Example 15 (the one shown in FIG. 1) except that the dispersion chamber has the structure wherein fluid is introduced via fluid-mixture inlet 12 into the dispersion chamber, wherein the channel is provided with a branching zone 13 and a joining zone 14 as shown in FIG. 6. Dispersion conditions were set as shown in Table 3.

Average diameter of particles of each fluid dispersion thus obtained was measured in the same manner as in Example 15 to make evaluation. Results obtained are shown in Table 3.

Electrophotographic photosensitive member were also produced in the same manner as in Example 15 except for using this fluid dispersion. Evaluation was made similarly. Results obtained are shown in Table 3.

COMPARATIVE EXAMPLES 18 TO 20

In Example 15 the manner of preparing the charge generation layer coating fluid was changed as shown below.

The fluid mixture was put to dispersion using a high-pressure dispersion apparatus having the same system construction as that of Example 15 (the one shown in FIG. 1) except that the dispersion chamber has the structure wherein the channel is provided with a bent zone 15 as shown in FIG. 7. Dispersion conditions were set as shown in Table 3.

Average diameter of particles of each fluid dispersion thus obtained was measured in the same manner as in Example 15 to make evaluation. Results obtained are shown in Table 3.

Electrophotographic photosensitive members were also produced in the same manner as in Example 15 except for using this fluid dispersion. Evaluation was made similarly. Results obtained are shown in Table 3.

COMPARATIVE EXAMPLE 21

A charge generation layer coating fluid was prepared in the same manner as in Example 26 except that dispersion was carried out using the high-pressure dispersion apparatus of Comparative Example 13 and under the conditions as shown in Table 3 to obtain a fluid dispersion.

Average diameter of particles of the fluid dispersion thus obtained was measured in the same manner as in Example 15 to make evaluation. Results obtained are shown in Table 3.

An electrophotographic photosensitive member was also produced in the same manner as in Example 26 except for using this fluid dispersion. Evaluation was made similarly. Results obtained are shown in Table 3.

COMPARATIVE EXAMPLE 22

A charge generation layer coating fluid was prepared in the same manner as in Example 27 except that dispersion was carried out using the high-pressure dispersion apparatus of Comparative Example 13 and under the conditions as shown in Table 3 to obtain a fluid dispersion.

Average diameter of particles of the fluid dispersion thus obtained was measured in the same manner as in Example 15 to make evaluation. Results obtained are shown in Table 3.

An electrophotographic photosensitive member was also produced in the same manner as in Example 27 except for using this fluid dispersion. Evaluation was made similarly. Results obtained are shown in Table 3.

COMPARATIVE EXAMPLE 23

A charge generation layer coating fluid was prepared in the same manner as in Example 28 except that dispersion was carried out using the high-pressure dispersion apparatus of Comparative Example 13 and under the conditions as shown in Table 3 to obtain a fluid dispersion.

Average diameter of particles of the fluid dispersion thus obtained was measured in the same manner as in Example 15 to make evaluation. Results obtained are shown in Table 3.

An electrophotographic photosensitive member was also produced in the same manner as in Example 28 except for using this fluid dispersion. Evaluation was made similarly. Results obtained are shown in Table 3.

COMPARATIVE EXAMPLE 24

The coating fluid prepared in Comparative Example 16 was put to further dispersion, and the dispersion machine was worked over a period of 1,000 hours under the same conditions as in Comparative Example 16. Thereafter, average diameter of particles of the fluid dispersion thus obtained was measured in the same manner as in Example 15 to make evaluation. As the result, the average particle diameter was 0.29 $\mu$m and its standard deviation was 0.28 $\mu$m.

An electrophotographic photosensitive member was also produced in the same manner as in Example 15 except for using this fluid dispersion. Evaluation was made similarly. As the result, fog was seen and good images were not obtainable. Also, the dispersion apparatus was disassembled, where the channel was seen to have worn at its joining zone.

COMPARATIVE EXAMPLE 25

The coating fluid prepared in Comparative Example 19 was put to further dispersion, and the dispersion machine was worked over a period of 1,000 hours under the same conditions as in Comparative Example 19. Thereafter, average diameter of particles of the fluid dispersion thus obtained was measured in the same manner as in Example 15 to make evaluation. As the result, the average particle diameter was 0.32 $\mu$m and its standard deviation was 0.27 $\mu$m.

An electrophotographic photosensitive member was also produced in the same manner as in Example 15 except for using this fluid dispersion. Evaluation was made similarly. As the result, fog was seen and good images were not obtainable. Also, the dispersion apparatus was disassembled, where the channel was seen to have worn at its bent zone.

To summarize the results in the above Examples and Comparative Examples, as in Comparative Examples 13 to 23 the electrophotographic photosensitive members are produced using the coating fluid obtained by the dispersion process in which a high pressure is applied to the fluid mixture containing a pigment to cause it to pass through the channel having a branching zone and a joining zone or having a bent zone. In such cases, good images are not obtainable when the coating fluid is obtained by one-cycle dispersion.

Faulty images can be made less occur when the coating fluids used are obtained by dispersion through more cycles, but images are still inferior to those in Examples, also resulting in not a good manufacture efficiency. Moreover, as a result of long-time dispersion as in Comparative Examples 24 and 25, the channel becomes worn at its joining zone or bent zone.

On the other hand, as in Examples 15 to 28, according to the dispersion process of the present invention, coating fluids which can produce electrophotographic photosensitive members free of faulty images such as spots and image fog can be obtained through one-cycle dispersion, and can be manufactured in a good efficiency. Also, as in Example 29, the orifice may hardly wear to enable stable manufacture and also promise low-cost maintenance.

EXAMPLE 30

In a mixed solvent of 220 parts of methanol and 60 parts of butanol, 20 parts of an alcohol-soluble copolymer nylon resin (average molecular weight: 29,000) and 20 parts of methoxymethylated nylon 6 (average molecular weight: 32,000) were dissolved to prepare a subbing layer coating solution. This coating solution was dip-coated on an aluminum cylinder (30 mm diameter and 360 mm long) serving as a support, followed by drying at 100° C. for 20 minutes to provide a subbing layer with a layer thickness of 0.7 μm.

Next, a charge generation layer fluid dispersion (coating fluid) was prepared by a process described below. As a fluid (A) to be jetted from the orifice, tetrahydrofuran was put into the tank 1 (FIG. 4). To prepare a fluid (B) to be injected into the hollow member, 50 parts of polyvinyl benzal resin (number-average molecular weight: 80,000; available from Kopia K.K.) was dissolved in 200 parts of cyclohexanone with stirring and 80 parts of the azo pigment represented by the formula (4) was further added, followed by mixing for 3 minutes by means of a homogenizer (trade name: ULTRATALUX T-25; manufactured by Ika Laboratory) to obtain a fluid mixture. This fluid mixture, fluid (B), was put in the tank 4 (FIG. 4).

The fluid (A) was fed into the dispersion chamber from the orifice 8 through the solvent injection opening 7, and the fluid (B) from the fluid mixture injection opening 10 to carry out dispersion by means of a high-pressure jet dispersion apparatus (DeBee 2000, manufactured by B.E.E. Co.) having the structure as shown in FIGS. 3 and 4. Dispersion conditions were set as shown below.

Dispersion pressure: $2\times10^5$ kPa

Orifice diameter: 0.1 mm

Hollow member shape: 1 mm in diameter (cylindrical) 100 mm in length

Hollow member diameter/orifice diameter: 10

Injection quantity: 100 ml/minute

Dispersion cycle: Once

Liquid flow rate: 900 m/sec

Volume average diameter of particles of the fluid dispersion thus obtained was measured with a centrifugal sedimentation type particle size distribution meter (CAPA 700, manufactured by Horiba Seisakusho) to make evaluation. Results obtained are shown in Table 4.

This fluid dispersion was diluted with cyclohexanone to have a solid content of 1.6% to prepare a charge generation layer coating fluid. This coating fluid was dip-coated on the above subbing layer, followed by drying at 100° C. for 15 minutes to form a charge generation layer with a layer thickness of 0.25 μm.

Next, 100 parts of the triphenylamine compound as used in Example 15 and 100 parts of polycarbonate resin (trade name: PANLITE L; available from Teijin Chemicals Ltd.; weight-average molecular weight: 40,000) were dissolved in a mixed solvent of 400 parts of monochlorobenzene and 200 parts of dichloromethane to prepare a charge transport layer coating solution. This solution was dip-coated on the charge generation layer, followed by drying at 130° C. for 30 minutes to form a charge transport layer with a layer thickness of 25 μm.

The electrophotographic photosensitive member thus produced was set in a normal development type copying machine in which a process of charging, exposure, development, transfer and cleaning was repeated in a cycle of 2.0 seconds. To make image evaluation, 1000 sheets of A4-size paper with printing percentage of 5% were fed into the copying machine and thereafter the number of white spots (those with a diameter of 0.01 mm or larger) in black solid images corresponding to the whole periphery of the photosensitive member was counted. Results obtained are shown in Table 4.

EXAMPLES 31 TO 40

Charge generation layer fluid dispersions (coating fluids) were prepared in the same manner as in Example 30 except that the conditions for dispersion carried out using the high-pressure jet dispersion apparatus were changed as shown in Table 4.

Average diameter of particles of each fluid dispersion thus obtained was measured in the same manner as in Example 30 to make evaluation. Results obtained are shown in Table 4.

Electrophotographic photosensitive members were also produced in the same manner as in Example 30 except for using this fluid dispersion. Evaluation was made similarly. Results obtained are shown in Table 4.

EXAMPLE 41

In Example 30 the manner of preparing the charge generation layer coating fluid was changed as shown below.

As the fluid (A) to be jetted from the orifice, 800 parts of cyclohexanone was put into the tank 1. To prepare the fluid (B) to be injected into the hollow member, 200 parts of methyl ethyl ketone, 90 parts of the azo pigment represented by the formula (5) and 50 parts of polyvinyl benzal resin (number-average molecular weight: 80,000; available from Kopia K.K.) were put into a stainless steel container, followed by mixing for 1 minute by means of a homogenizer (trade name: ULTRATALUX T-25; manufactured by Ika Laboratory).

The fluid mixture obtained was put in the same high-pressure jet dispersion apparatus as that in Example 30 to carry out dispersion under the conditions shown in Table 4.

Average diameter of particles of the fluid dispersion thus obtained was measured in the same manner as in Example 30 to make evaluation. Results obtained are shown in Table 4.

This fluid dispersion was diluted with methyl ethyl ketone to have a solid content of 1.8% to prepare a charge generation layer coating fluid. This coating fluid was dip-coated on a subbing layer formed in the same manner as in Example 30, followed by drying at 80° C. for 15 minutes to form a charge generation layer with a layer thickness of 0.25 μm.

A charge transport layer was further formed in the same manner as in Example 30, thus an electrophotographic photosensitive member was produced. Evaluation was made similarly. Results obtained are shown in Table 4.

EXAMPLE 42

In Example 30 the manner of preparing the charge generation layer coating fluid was changed as shown below.

To prepare the fluid (A) to be jetted from the orifice, 50 parts of polyvinyl butyral resin (trade name: S-LEC BLS; available from Sekisui Chemical Co., Ltd.) was dissolved in a mixed solvent of 600 parts of cyclohexanone and 200 parts of methyl ethyl ketone with stirring. To prepare the fluid (B) to be injected into the hollow member, 200 parts of methyl ethyl ketone and 90 parts of the azo pigment represented by the formula (5) were put into a stainless steel container, followed by mixing for 10 minutes by means of an ultrasonic dispersion machine.

The fluid mixture obtained was put in the same high-pressure jet dispersion apparatus as that in Example 30 to carry out dispersion under the conditions shown in Table 4. Average diameter of particles of the fluid dispersion thus obtained was measured in the same manner as in Example 30 to make evaluation. Results obtained are shown in Table 4.

This fluid dispersion was diluted with methyl ethyl ketone to have a solid content of 1.6% to prepare a charge generation layer coating fluid. This coating fluid was dip-coated on a subbing layer formed in the same manner as in Example 30, followed by drying at 80° C. for 10 minutes to form a charge generation layer with a layer thickness of 0.20 μm.

A charge transport layer was further formed in the same manner as in Example 30, thus an electrophotographic photosensitive member was produced. Evaluation was made similarly. Results obtained are shown in Table 4.

EXAMPLE 43

In Example 30 the manner of preparing the charge generation layer coating fluid and charge transport layer coating solution was changed as shown below.

To prepare the fluid (A) to be jetted from the orifice, 600 parts of cyclohexanone and 200 parts of tetrahydrofuran were mixed with stirring. To prepare the fluid (B) to be injected into the hollow member, 200 parts of tetrahydrofuran, 90 parts of azo pigment represented by the formula (6) and 50 parts of polyvinyl butyral resin (trade name: S-LEC BX-1; available from Sekisui Chemical Co., Ltd.) were put into a stainless steel container, followed by mixing for 10 minutes by means of an ultrasonic dispersion machine.

The fluid mixture obtained was put in the same high-pressure jet dispersion apparatus as that in Example 30 to carry out dispersion under the same conditions as those in Example 30. Average diameter of particles of the fluid dispersion thus obtained was measured in the same manner as in Example 30 to make evaluation. Results obtained are shown in Table 4.

This fluid dispersion was diluted with tetrahydrofuran to have a solid content of 1.6% to prepare a charge generation layer coating fluid. This coating fluid was dip-coated on a subbing layer formed in the same manner as in Example 30, followed by drying at 80° C. for 15 minutes to form a charge generation layer with a layer thickness of 0.20 μm.

Next, 80 parts of the hydrazone compound as used in Example 28 and 100 parts of styrene-methyl methacrylate copolymer resin (trade name: ESTYRENE; available from Shin Nittetsu Kagaku K.K.) were dissolved in a mixed solvent of 400 parts of monochlorobenzene and 200 parts of dichloromethane to prepare a charge transport layer coating solution. This solution was dip-coated on the charge generation layer, followed by drying at 110° C. for 60 minutes to form a charge transport layer with a layer thickness of 20 μm.

The electrophotographic photosensitive member thus produced was set in a normal development type copying machine in which a process of charging, exposure, development, transfer and cleaning was repeated in a cycle of 5.0 seconds. To make image evaluation, 1000 sheets of A4-size paper with the printing percentage of 5% were fed into the copying machine and thereafter the number of white spots (those with a diameter of 0.01 mm or larger) in black solid images corresponding to the whole periphery of the photosensitive member was counted. Results obtained are shown in Table 4.

EXAMPLE 44

The coating fluid prepared in Example 30 was put to further dispersion, and the dispersion machine was worked over a period of 1,000 hours under the same conditions as in Example 30. Thereafter, average diameter of particles of the fluid dispersion thus obtained was measured in the same manner as in Example 30 to make evaluation. As the result, the average particle diameter was 0.10 μm and its standard deviation was 0.09 μm.

An electrophotographic photosensitive member was also produced in the same manner as in Example 30 except for using this fluid dispersion. Evaluation was made similarly. As the result, good images were obtainable. Also, the dispersion apparatus was disassembled and the orifice diameter was measured, where there was no change due to wear or the like.

COMPARATIVE EXAMPLE 26

In Example 30 the manner of preparing the charge generation layer coating fluid was changed as shown below.

800 parts of tetrahydrofuran and 200 parts of cyclohexanone were put into a stainless steel container, and 50 parts of polyvinyl benzal resin (number-average molecular weight: 80,000; available from Kopia K.K.) and 80 parts of the azo pigment represented by the formula (4) were put into it, followed by mixing for 3 minutes by means of a homogenizer (trade name: ULTRATALUX T-25; manufactured by Ika Laboratory).

Figure 5:
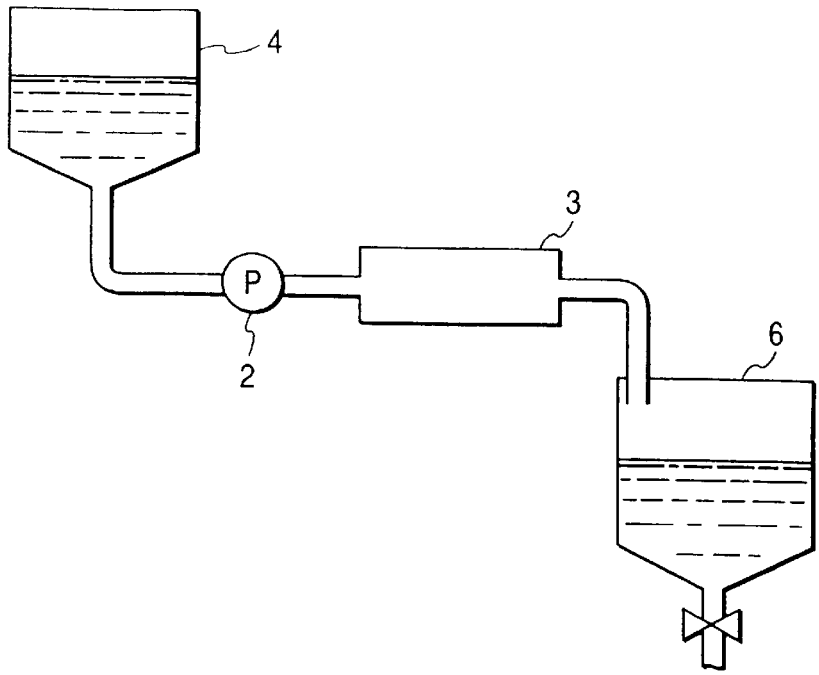
FIG. 5 PRIOR ART
FIG. 5 is a schematic illustration of an example of the construction of a conventional high-pressure dispersion machine.

The fluid mixture was put to dispersion using a high-pressure dispersion apparatus having the system construction as shown in FIG. 5, having the structure wherein the channel is provided with a branching zone and a joining zone as shown in FIG. 6. Dispersion conditions were set as shown in Table 4.

Average diameter of particles of the fluid dispersion thus obtained was measured in the same manner as in Example 30 to make evaluation. Results obtained are shown in Table 4.

An electrophotographic photosensitive member was also produced in the same manner as in Example 30 except for using this fluid dispersion. Evaluation was made similarly. Results obtained are shown in Table 4.

COMPARATIVE EXAMPLE 27

In Comparative Example 26 the manner of preparing the charge generation layer coating fluid was changed as shown below.

800 parts of cyclohexanone and 200 parts of methyl ethyl ketone were put into a stainless steel container, and 50 parts of polyvinyl benzal resin (number-average molecular weight: 80,000; available from Kopia K.K.) was dissolved therein, and 90 parts of the azo pigment represented by the formula (5) was further put into it, followed by mixing for 1 minute by means of a homogenizer (trade name: ULTRATALUX T-25; manufactured by Ika Laboratory).

The fluid mixture obtained was put to dispersion using the same high-pressure dispersion apparatus as that in Comparative Example 26 and under the conditions as shown in Table 4.

Average diameter of particles of the fluid dispersion thus obtained was measured in the same manner as in Example 30 to make evaluation. Results obtained are shown in Table 4.

An electrophotographic photosensitive member was also produced in the same manner as in Example 30 except for using this fluid dispersion. Evaluation was made similarly. Results obtained are shown in Table 4.

COMPARATIVE EXAMPLE 28

In Comparative Example 26 the manner of preparing the charge generation layer coating fluid was changed as shown below.

600 parts of cyclohexanone and 400 parts of tetrahydrofuran were put into a stainless steel container, and 50 parts of polyvinyl benzal resin (trade name: S-LEC BX-1; available from Sekisui Chemical Co., Ltd.) was dissolved therein, and 90 parts of the azo pigment represented by the formula (6) was further put into it, followed by mixing for 10 minutes by means of an ultrasonic dispersion machine.

The fluid mixture obtained was put to dispersion using the same high-pressure dispersion apparatus as that in Comparative Example 26 and under the conditions as shown in Table 4.

Average diameter of particles of the fluid dispersion thus obtained was measured in the same manner as in Example 30 to make evaluation. Results obtained are shown in Table 4.

An electrophotographic photosensitive member was also produced in the same manner as in Example 43 except for using this fluid dispersion. Evaluation was made similarly. Results obtained are shown in Table 4.

COMPARATIVE EXAMPLE 29

In Comparative Example 26 the manner of preparing the charge generation layer coating fluid was changed as shown below.

The fluid mixture was put to dispersion using a high-pressure dispersion apparatus having the same system construction as that of Comparative Example 26 (the one shown in FIG. 5) except that the dispersion chamber has the structure wherein the channel is provided with a bent zone as shown in FIG. 7. Dispersion conditions were set as shown in Table 4.

Average diameter of particles of the fluid dispersion thus obtained was measured in the same manner as in Example 30 to make evaluation. Results obtained are shown in Table 4.

An electrophotographic photosensitive member was also produced in the same manner as in Example 30 except for using this fluid dispersion. Evaluation was made similarly. Results obtained are shown in Table 4.

COMPARATIVE EXAMPLE 30

A charge generation layer coating fluid was prepared in the same manner as in Comparative Example 29 except that dispersion was carried out using the fluid mixture formulated in Comparative Example 27 and under the dispersion conditions as shown in Table 4 to obtain a fluid dispersion.

Average diameter of particles of the fluid dispersion thus obtained was measured in the same manner as in Example 30 to make evaluation. Results obtained are shown in Table 4.

An electrophotographic photosensitive member was also produced in the same manner as in Example 30 except for using this fluid dispersion. Evaluation was made similarly. Results obtained are shown in Table 4.

COMPARATIVE EXAMPLE 31

A charge generation layer coating fluid was prepared in the same manner as in Comparative Example 29 except that dispersion was carried out using the fluid mixture formulated in Comparative Example 28 and under the dispersion conditions as shown in Table 4 to obtain a fluid dispersion.

Average diameter of particles of the fluid dispersion thus obtained was measured in the same manner as in Example 30 to make evaluation. Results obtained are shown in Table 4.

An electrophotographic photosensitive member was also produced in the same manner as in Example 30 except for using this fluid dispersion. Evaluation was made similarly. Results obtained are shown in Table 4.

COMPARATIVE EXAMPLES 32 TO 35

Charge generation layer coating fluids were prepared in the same manner as in Comparative Example 29 except that dispersion was carried out using the fluid mixture formulated in Comparative Example 28 and under the dispersion conditions as shown in Table 4 to obtain a fluid dispersion.

Average diameter of particles of each fluid dispersion thus obtained was measured in the same manner as in Example 30 to make evaluation. Results obtained are shown in Table 4.

Electrophotographic photosensitive members were also produced in the same manner as in Example 30 except for using this fluid dispersion. Evaluation was made similarly. Results obtained are shown in Table 4.

COMPARATIVE EXAMPLE 36

The coating fluid prepared in Comparative Example 26 was put to further dispersion, and the dispersion machine was worked over a period of 1,000 hours under the same conditions as in Comparative Example 26. Thereafter, average diameter of particles of the fluid dispersion thus obtained was measured in the same manner as in Example 30 to make evaluation. As the result, the average particle diameter was 0.19 $\mu$m and its standard deviation was 0.20 $\mu$m.

An electrophotographic photosensitive member was also produced in the same manner as in Example 30 except for using this fluid dispersion. Evaluation was made similarly. As the result, fog was seen and good images were not obtainable. Also, the dispersion apparatus was disassembled, where the channel was seen to have worn at its joining zone.

COMPARATIVE EXAMPLE 37

The coating fluid prepared in Comparative Example 28 was put to further dispersion, and the dispersion machine was worked over a period of 1,000 hours under the same conditions as in Comparative Example 28. Thereafter, average diameter of particles of the fluid dispersion thus obtained was measured in the same manner as in Example 30 to make evaluation. As the result, the average particle diameter was 0.20 $\mu$m and its standard deviation was 0.21 $\mu$m.

An electrophotographic photosensitive member was also produced in the same manner as in Example 30 except for using this fluid dispersion. Evaluation was made similarly. As the result, fog was seen and good images were not obtainable. Also, the dispersion apparatus was disassembled, where the channel was seen to have worn at its bent zone.

To summarize the results in the above Examples and Comparative Examples, as in Comparative Examples 26 to 35 the electrophotographic photosensitive members are produced using the coating fluid obtained by the dispersion process in which a high pressure is applied to the fluid mixture containing a pigment to cause it to pass through the channel having a branching zone and a joining zone or having a bent zone. In such cases, spots remained to appear on images however dispersion conditions were changed to prepare the coating fluids to produce photosensitive members. Agglomeration was seen in the fluid dispersions. Moreover, as a result of long-time dispersion as in Comparative Examples 36 and 37, the channel becomes worn at its joining zone or bent zone.

On the other hand, as in Examples 30 to 43, according to the dispersion process of the present invention, coating fluids which can produce electrophotographic photosensitive members free of faulty images such as spots and image fog can be obtained by one cycle dispersion, and can be manufactured in a good efficiency. Also, as in Example 44, the orifice may hardly wear to enable stable manufacture and also promise low-cost maintenance.

Preparation of Fluid Dispersions:

EXAMPLE 45

In 60 parts of monochlorobenzene, 10 parts of tetrafluoroethylene resin powder (trade name: LUBRON L-2, available from Daikin Industries, Ltd.) and 0.4 part (as solid content) of comb type fluorine graft polymer (trade name: ARON GF300, available from Toagosei Chemical Industry Co., Ltd.) were mixed and stirred. Thereafter, dispersion was carried out by means of the apparatus shown in FIGS. 1 and 2.

Pressures, flow rates and treatment cycles at the time of the dispersion are shown in Table 5 together with the results of measurement on materials having been dispersed. The orifice used was 0.15 mm diameter and the hollow member used was 1.0 mm in diameter and 100 mm in length.

The material having been dispersed was evaluated by examining the state of dispersion and distribution of tetrafluoroethylene particles in the fluid dispersion by means of particle size distribution measuring meter made by Horiba Seisakusyo (trade name: CAPA700), where the average particle diameter of the material having been dispersed, for each type of dispersion conditions and the percentage of presence of coarse particles of 0.5 μm or larger in diameter were measured. Results obtained are shown in Table 5.

COMPARATIVE EXAMPLE 38

Using a material formulated in the same manner as in Example 45, dispersion was carried out by means of a high-pressure dispersion apparatus (trade name: MICROFLUIDIZER M110-E/H; manufactured by Microfluidics Co., U.S.A.) having the dispersion chamber shown in FIG. 6. Pressures, flow rates and treatment cycles at the time of the dispersion are shown in Table 5 together with the results of measurement on materials having been dispersed.

COMPARATIVE EXAMPLE 39

Dispersion was carried out in the same manner as in Example 45 except that, in place of the high-pressure treatment made in Example 45 and Comparative Example 38, a sand mill making use of usual media such as glass beads was used.

The number of revolutions of the sand mill disk was set at 500, 1,000 and 2,000 rpm, and dispersion was carried out for 30, 60 and 120 minutes for each number of revolutions. Results of measurement on the material having been dispersed are shown in Table 5.

Production of Electrophotographic Photosensitive Members:

EXAMPLE 46

200 parts of conductive titanium oxide powder coated with tin oxide containing 10% of antimony oxide, 200 parts of white titanium oxide powder, 400 parts of phenolic resin, 400 parts of 1-methoxy-2-propanol and 100 parts of methanol were put into a sand mill making use of glass beads of 1 mm diameter, and dispersion was carried out to prepare a conductive subbing layer coating material.

The above coating material was dip-coated on an aluminum cylinder of 30 mm diameter and 357.5 mm long (wall thickness: 0.8 mm), followed by drying at 140° C. for 30 minutes to provide a conductive subbing layer with a dried layer thickness of 20 μm.

Next, an intermediate layer coating material was prepared using 90 parts of N-methoxymethylated nylon 6, 30 parts of 6-12-66-610 copolymer nylon, 500 parts of methanol and 500 parts of butanol, and was dip-coated on the conductive subbing layer, followed by drying to form an intermediate layer with a dried layer thickness of 0.5 μm.

Next, 40 parts of a disazo pigment represented by the formula:

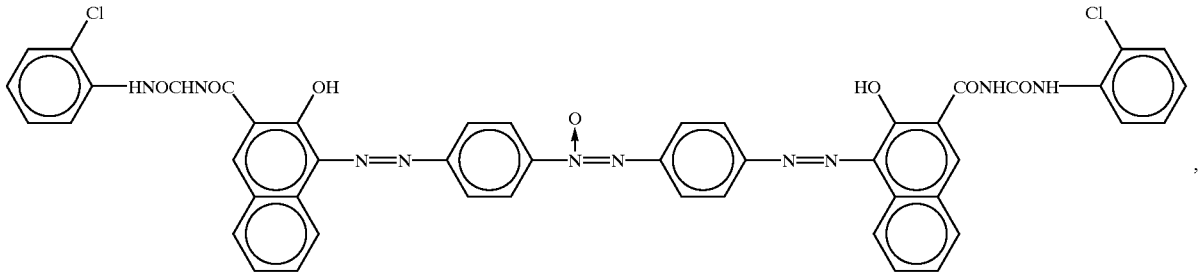

10 parts of polyvinyl (p-fluoro)benzal resin represented by the formula:

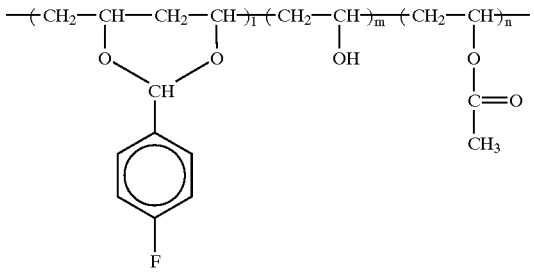

(l, m and n are positive integers)

(weight-average molecular weight: $(1.6\pm0.3)\times10^5$; degree of benzalation: 80 to 70), and 800 parts of cyclohexanone were put into a sand mill making use of glass beads, and dispersion was carried out to prepare a charge generation layer coating material. This coating material was dip-coated on the intermediate layer to form a charge generation layer with a dried coating weight of 200 mg/m$^2$.

Next, 70 parts each of the tetrafluoroethylene resin powder fluid dispersions (nine dispersions) obtained in Example 45 were taken up and were each added and dissolved in a mixture of 50 parts of bisphenol-Z type polycarbonate resin (viscosity-average molecular weight: 22,000; trade name: U-PIRON Z200; available from Mitsubishi Gas Chemical Company, Inc.), 120 parts of monochlorobenzene and 50 parts of dichloromethane. In the solution obtained, 28 parts of a compound represented by the formula:

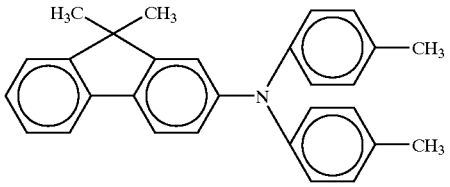

and 12 parts of a compound represented by the formula:

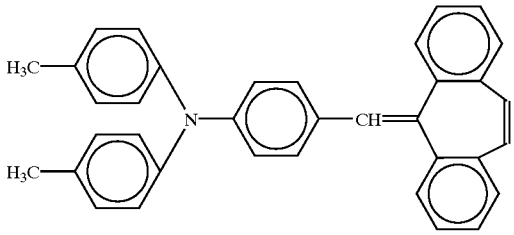

were dissolved to obtain a charge transport layer coating material, which was then dip-coated on the charge generation layer, followed by drying to provide a charge transport layer with a dried layer thickness of 25 $\mu$m.

The electrophotographic photosensitive members thus obtained were designated as Example Photosensitive Members 1 to 9 correspondingly to the types of conditions for dispersing the tetrafluoroethylene resin powder, in the order of the types of conditions shown in Table 5.

COMPARATIVE EXAMPLE 40

Electrophotographic photosensitive members were produced in the same manner as in Example 46 except that the tetrafluoroethylene resin powder fluid dispersions used therein were replaced with the ten types obtained in Comparative Example 38 and the nine types obtained in Comparative Example 39.

Comparative photosensitive members obtained from the Comparative Example 38 ten types were designated as Comparative Photosensitive Members 1 to 10 in the order of the types of dispersion conditions shown in Table 5, and comparative photosensitive members obtained from the Comparative Example 39 nine types were designated as Comparative Photosensitive Members 11 to 19 in the order of the types of dispersion conditions.

Example Photosensitive Members 1, 3, 4, 6, 7 and 9 and Comparative Photosensitive Members 1, 3, 5, 6, 8, 10, 11, 13, 14, 16, 17 and 19 were evaluated using a PPC copying machine NP-6030, manufactured by CANON INC., in which a charging process is carried out by direct charging. Evaluation methods are shown below, and the results of evaluation are shown in Table 6.

Evaluation methods Potential:

Setting light area potential at −650 V, the photosensitive member was irradiated in amount of light of 0.9 lux·sec, where its surface potential and its residual potential after exposure were measured at the initial stage and after 60,000-sheet continuous copying (running).

Photosensitive member defects:

The surface of the photosensitive member was visually observed after 60,000-sheet continuous copying to examine the degree at which any agglomerates of tetrafluoroethylene resin powder stood bare to the photosensitive member surface.

Running scrape:

The amount of scrape of the photosensitive member surface after 60,000-sheet continuous copying was determined by measuring layer thickness.

Image evaluation:

At the initial stage and after 60,000-sheet running in the same continuous copying, the quality level of images were evaluated chiefly from the viewpoint of scratch marks.

EXAMPLE 47

Electrophotographic photosensitive members were produced in the same manner as in Example 46 except that the disazo pigment used therein was replaced with a phthalocyanine pigment represented by the structural formula:

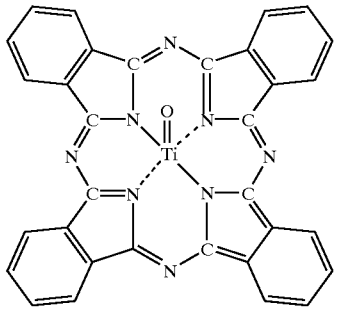

to provide example photosensitive members. These were designated as Example Photosensitive Members 10 to 18 correspondingly to the types of conditions for dispersing the tetrafluoroethylene resin powder.

COMPARATIVE EXAMPLE 41

Electrophotographic photosensitive members were produced in the same manner as in Example 47 except that the tetrafluoroethylene resin powder fluid dispersions used therein were replaced with the ten types obtained in Comparative Example 38 and the nine types obtained in Comparative Example 39.

Comparative photosensitive members obtained from the Comparative Example 38 ten types were designated as Comparative Photosensitive Members 20 to 29 in the order of the types of dispersion conditions shown in Table 5, and comparative photosensitive members obtained from the Comparative Example 39 nine types were designated as Comparative Photosensitive Members 30 to 38 in the order of the types of dispersion conditions.

Example Photosensitive Members 10, 12, 13, 15, 16 and 18 and Comparative Photosensitive Members 20, 22, 24, 25, 27, 29, 30, 32, 33, 35, 36 and 38 were evaluated using a laser beam printer LBP-720, manufactured by CANON INC., in which a charging process is carried out by direct charging. Evaluation was made by visually observing halftone images at the initial stage and after running on 8,000-sheet image reproduction. Results obtained are shown in Table 7.

TABLE 1

| | Dispersion conditions | | | | | | | |
|---|---|---|---|---|---|---|---|---|
| | Dispersion pressure (kPa) | Orifice diameter (mm) | Hollow member diameter (mm) | Hollow member diameter/orifice diameter | Hollow member length (mm) | Dispersion cycle (time) | Back pressure (kPa) | Liquid flow rate (m/sec) |
| Example: | | | | | | | | |
| 1 | $1 \times 10^5$ | 0.1 | 1.0 | 10 | 100 | 1 | $2 \times 10^3$ | 640 |
| 2 | $3 \times 10^5$ | 0.05 | 2.5 | 50 | 100 | 1 | $8 \times 10^3$ | 1600 |
| 3 | $1 \times 10^5$ | 0.3 | 0.9 | 3 | 30 | 1 | $2 \times 10^3$ | 100 |
| 4 | $2 \times 10^5$ | 0.05 | 1.0 | 20 | 60 | 1 | $5 \times 10^3$ | 800 |
| 5 | $1 \times 10^5$ | 0.3 | 3.0 | 10 | 300 | 1 | 0 | 100 |
| 6 | $1 \times 10^4$ | 0.1 | 1.0 | 10 | 30 | 1 | 0 | 150 |
| 7 | $3.2 \times 10^5$ | 0.01 | 1.0 | 100 | 100 | 1 | $1 \times 10^4$ | 2000 |
| 8 | $5 \times 10^3$ | 0.1 | 1.0 | 10 | 30 | 1 | 0 | 100 |
| 9 | $3 \times 10^4$ | 1.0 | 10.0 | 10 | 300 | 1 | $1 \times 10^3$ | 60 |
| 10 | $1 \times 10^5$ | 0.3 | 0.6 | 2 | 100 | 1 | $2 \times 10^3$ | 100 |
| 11 | $5 \times 10^3$ | 0.1 | 1.0 | 10 | 100 | 1 | $1 \times 10^4$ | 100 |
| 12 | $1 \times 10^5$ | 0.1 | 1.0 | 10 | 100 | 1 | $2 \times 10^3$ | 640 |
| 13 | $1 \times 10^5$ | 0.1 | 1.0 | 10 | 100 | 1 | $2 \times 10^3$ | 640 |
| Comparative Example: | | | | | | | | |
| 1 | $1 \times 10^5$ | 0.1 | — | — | — | 1 | 0 | 640 |
| 2 | $3.2 \times 10^5$ | 0.1 | — | — | — | 1 | 0 | 1200 |
| 3 | $1 \times 10^4$ | 0.1 | — | — | — | 1 | 0 | 150 |
| 4 | $2 \times 10^5$ | 0.1 | — | — | — | 1 | $1 \times 10^4$ | 900 |
| 5 | $1 \times 10^5$ | 0.1 | — | — | — | 3 | 0 | 640 |
| 6 | $3 \times 10^5$ | 0.1 | — | — | — | 1 | $1 \times 10^4$ | 1100 |
| 7 | $2 \times 10^5$ | 0.2 | — | — | — | 1 | $1 \times 10^4$ | 750 |
| 8 | $1 \times 10^5$ | 0.1 | — | — | — | 3 | 0 | 640 |
| 9 | $1 \times 10^5$ | 0.1 | — | — | — | 3 | 0 | 640 |
| 10 | $1 \times 10^5$ | 0.1 | — | — | — | 3 | 0 | 640 |

TABLE 2

| | Evaluation results | | | | | |
|---|---|---|---|---|---|---|
| | | | Image evaluation (* black spots) | | | |
| | | | Coated 24 hours after dispersion | | Coated 50 days after dispersion | |
| | Average particle diameter (μm) | Standard deviation (μm) | 0.05 mm* or larger | 0.01 mm* or larger | 0.05 mm* or larger | Fog level |
| Example: | | | | | | |
| 1 | 0.14 | 0.10 | 0 | 1 | 0 | Especially good |
| 2 | 0.13 | 0.09 | 0 | 0 | 0 | Especially good |
| 3 | 0.14 | 0.11 | 0 | 1 | 0 | Especially good |
| 4 | 0.13 | 0.10 | 0 | 0 | 0 | Especially good |
| 5 | 0.13 | 0.12 | 0 | 1 | 0 | Especially good |
| 6 | 0.11 | 0.09 | 0 | 0 | 0 | Especially good |
| 7 | 0.11 | 0.10 | 0 | 1 | 0 | Good |
| 8 | 0.19 | 0.13 | 0 | 2 | 0 | Good |
| 9 | 0.16 | 0.15 | 0 | 1 | 0 | Good |
| 10 | 0.17 | 0.18 | 0 | 1 | 0 | Good |
| 11 | 0.17 | 0.19 | 0 | 2 | 0 | Good |
| 12 | 0.14 | 0.10 | 0 | 1 | 0 | Especially good |
| 13 | 0.14 | 0.10 | 0 | 0 | 0 | Especially good |
| Comparative Example: | | | | | | |
| 1 | 0.20 | 0.22 | 2 | 7 | 2 | Good |
| 2 | 0.19 | 0.21 | 1 | 5 | 3 | Good |
| 3 | 0.25 | 0.29 | 5 | 20 | 5 | Thin fog |
| 4 | 0.19 | 0.25 | 1 | 6 | 4 | Good |
| 5 | 0.15 | 0.12 | 0 | 3 | 2 | Very thin fog |
| 6 | 0.21 | 0.19 | 1 | 8 | 2 | Good |
| 7 | 0.22 | 0.20 | 2 | 10 | 3 | Good |

TABLE 2-continued

| | Evaluation results | | | | | |
|---|---|---|---|---|---|---|
| | | | Image evaluation (* black spots) | | | |
| | Average particle diameter (μm) | Standard deviation (μm) | Coated 24 hours after dispersion: 0.05 mm* or larger | Coated 24 hours after dispersion: 0.01 mm* or larger | Coated 50 days after dispersion: 0.05 mm* or larger | Fog level |
| 8 | 0.15 | 0.14 | 0 | 2 | 4 | Very thin fog |
| 9 | 0.14 | 0.16 | 0 | 2 | 5 | Very thin fog |
| 10 | 0.13 | 0.14 | 0 | 3 | 4 | Good |

TABLE 3

| | Dispersion conditions | | | | | | | | Evaluation results | | |
|---|---|---|---|---|---|---|---|---|---|---|---|
| | Dispersion pressure (kPa) | Orifice diameter (mm) | Hollow member diameter (mm) | Hollow member diam./orifice diam. | Hollow member length (mm) | Dispersion cycle (time) | Back pressure (kPa) | Liquid flow rate (m/sec.) | Average particle diam. (μm) | Standard deviation (μm) | * Image evaluation |
| Example: | | | | | | | | | | | |
| 15 | $1 \times 10^5$ | 0.1 | 1.0 | 10 | 100 | 1 | 0 | 640 | 0.10 | 0.10 | 0 |
| 16 | $3 \times 10^5$ | 0.05 | 2.5 | 50 | 100 | 1 | 0 | 1600 | 0.09 | 0.10 | 0 |
| 17 | $1 \times 10^5$ | 0.3 | 1.5 | 5 | 30 | 1 | 0 | 100 | 0.11 | 0.12 | 0 |
| 18 | $3 \times 10^5$ | 0.05 | 1.0 | 20 | 30 | 1 | $5 \times 10^3$ | 1600 | 0.12 | 0.11 | 0 |
| 19 | $1 \times 10^5$ | 0.3 | 1.5 | 5 | 300 | 1 | 0 | 100 | 0.11 | 0.09 | 0 |
| 20 | $5 \times 10^4$ | 0.1 | 1.0 | 10 | 30 | 1 | 0 | 420 | 0.10 | 0.12 | 0 |
| 21 | $3.2 \times 10^5$ | 0.01 | 1.0 | 100 | 300 | 1 | $1 \times 10^4$ | 2000 | 0.13 | 0.12 | 1 |
| 22 | $3 \times 10^4$ | 0.3 | 0.9 | 3 | 100 | 1 | 0 | 80 | 0.14 | 0.12 | 1 |
| 23 | $3 \times 10^4$ | 1.0 | 10.0 | 10 | 300 | 1 | $1 \times 10^3$ | 60 | 0.15 | 0.13 | 2 |
| 24 | $1 \times 10^5$ | 0.1 | 1.0 | 10 | 30 | 1 | $1 \times 10^3$ | 640 | 0.13 | 0.14 | 1 |
| 25 | $1 \times 10^5$ | 0.1 | 1.0 | 10 | 100 | 1 | 0 | 640 | 0.11 | 0.10 | 0 |
| 26 | $1 \times 10^5$ | 0.1 | 1.0 | 10 | 100 | 1 | 0 | 640 | 0.12 | 0.09 | 0 |
| 27 | $1 \times 10^5$ | 0.1 | 1.0 | 10 | 100 | 1 | 0 | 640 | 0.11 | 0.10 | 0 |
| 28 | $1 \times 10^5$ | 0.1 | 1.0 | 10 | 100 | 1 | 0 | 640 | 0.14 | 0.13 | 1 |
| Comparative Example: | | | | | | | | | | | |
| 13 | $3 \times 10^4$ | 0.1 | — | — | — | 3 | 0 | 250 | 0.25 | 0.25 | 5 |
| 14 | $7 \times 10^4$ | 0.1 | — | — | — | 2 | 0 | 500 | 0.22 | 0.24 | 8 |
| 15 | $1 \times 10^5$ | 0.1 | — | — | — | 1 | 0 | 640 | 0.23 | 0.28 | 12 |
| 16 | $3.2 \times 10^5$ | 0.1 | — | — | — | 4 | $1 \times 10^4$ | 1200 | 0.20 | 0.23 | 6 |
| 17 | $1 \times 10^5$ | 0.2 | — | — | — | 2 | 0 | 300 | 0.27 | 0.27 | 7 |
| 18 | $3 \times 10^4$ | 0.1 | — | — | — | 3 | 0 | 250 | 0.25 | 0.26 | 9 |
| 19 | $1 \times 10^5$ | 0.1 | — | — | — | 4 | 0 | 640 | 0.18 | 0.20 | 5 |
| 20 | $3.2 \times 10^5$ | 0.1 | — | — | — | 1 | $1 \times 10^4$ | 1200 | 0.26 | 0.28 | 19 |
| 21 | $1 \times 10^5$ | 0.1 | — | — | — | 1 | 0 | 640 | 0.25 | 0.24 | 12 |
| 22 | $1 \times 10^5$ | 0.1 | — | — | — | 1 | 0 | 640 | 0.26 | 0.22 | 13 |
| 23 | $1 \times 10^5$ | 0.1 | — | — | — | 1 | 0 | 640 | 0.31 | 0.33 | 18 |

*Number of black spots

TABLE 4

| | Dispersion conditions | | | | | | | | Evaluation results | | |
|---|---|---|---|---|---|---|---|---|---|---|---|
| | Dispersion pressure (kPa) | Orifice diameter (mm) | Hollow member diameter (mm) | Hollow member diam./orifice diam. | Hollow member length (mm) | Injection rate (ml/min) | Injection rate/jet-out* rate | Liquid flow rate (m/sec.) | Average particle diam. (μm) | Standard deviation (μm) | * Image evaluation |
| Example: | | | | | | | | | | | |
| 30 | $2 \times 10^5$ | 0.1 | 1.0 | 10 | 100 | 100 | 0.2 | 900 | 0.09 | 0.09 | 0 |
| 31 | $3 \times 10^5$ | 0.05 | 2.5 | 50 | 100 | 30 | 1.0 | 1600 | 0.08 | 0.09 | 0 |
| 32 | $1 \times 10^5$ | 0.3 | 1.5 | 5 | 30 | 200 | 0.2 | 100 | 0.12 | 0.11 | 0 |
| 33 | $3 \times 10^5$ | 0.05 | 1.0 | 20 | 30 | 100 | 1.0 | 1600 | 0.10 | 0.10 | 0 |

TABLE 4-continued

| | Dispersion conditions | | | | | | | | Evaluation results | | |
|---|---|---|---|---|---|---|---|---|---|---|---|
| | Dispersion pressure (kPa) | Orifice diameter (mm) | Hollow member diameter (mm) | Hollow member diam./orifice diam. | Hollow member length (mm) | Injection rate (ml/min) | Injection rate/jet-out* rate | Liquid flow rate (m/sec.) | Average particle diam. (μm) | Standard deviation (μm) | * Image evaluation |
| 34 | $1 \times 10^5$ | 0.3 | 1.5 | 5 | 300 | 20 | 0.05 | 100 | 0.10 | 0.09 | 0 |
| 35 | $5 \times 10^4$ | 0.1 | 1.0 | 10 | 30 | 50 | 0.2 | 420 | 0.12 | 0.11 | 0 |
| 36 | $3.2 \times 10^5$ | 0.01 | 1.0 | 100 | 300 | 150 | 2.0 | 2000 | 0.13 | 0.11 | 1 |
| 37 | $3 \times 10^4$ | 0.3 | 0.9 | 3 | 100 | 10 | 0.01 | 80 | 0.15 | 0.13 | 1 |
| 38 | $3 \times 10^4$ | 1.0 | 10.0 | 10 | 300 | 100 | 0.01 | 60 | 0.13 | 0.13 | 1 |
| 39 | $3 \times 10^4$ | 0.1 | 1.0 | 10 | 30 | 30 | 0.2 | 250 | 0.14 | 0.14 | 1 |
| 40 | $1 \times 10^5$ | 0.1 | 1.0 | 10 | 100 | 70 | 0.2 | 640 | 0.10 | 0.09 | 0 |
| 41 | $2 \times 10^5$ | 0.1 | 1.0 | 10 | 100 | 100 | 0.2 | 900 | 0.11 | 0.10 | 0 |
| 42 | $2 \times 10^5$ | 0.1 | 1.0 | 10 | 100 | 100 | 0.2 | 900 | 0.12 | 0.09 | 0 |
| 43 | $2 \times 10^5$ | 0.1 | 1.0 | 10 | 100 | 100 | 0.2 | 900 | 0.13 | 0.10 | 1 |
| Comparative Example: | | | | | | | | | | | |
| 26 | $3 \times 10^4$ | 0.1 | — | — | — | — | — | 250 | 0.29 | 0.33 | 15 |
| 27 | $3 \times 10^4$ | 0.1 | — | — | — | — | — | 250 | 0.35 | 0.39 | 12 |
| 28 | $7 \times 10^4$ | 0.1 | — | — | — | — | — | 500 | 0.25 | 0.29 | 14 |
| 29 | $7 \times 10^4$ | 0.1 | — | — | — | — | — | 500 | 0.42 | 0.36 | 15 |
| 30 | $7 \times 10^4$ | 0.1 | — | — | — | — | — | 500 | 0.38 | 0.37 | 15 |
| 31 | $1 \times 10^5$ | 0.1 | — | — | — | — | — | 640 | 0.28 | 0.34 | 13 |
| 32 | $3 \times 10^4$ | 0.1 | — | — | — | — | — | 250 | 0.59 | 0.42 | 22 |
| 33 | $2 \times 10^5$ | 0.2 | — | — | — | — | — | 750 | 0.48 | 0.46 | 18 |
| 34 | $3.2 \times 10^5$ | 0.1 | — | — | — | — | — | 1200 | 0.55 | 0.41 | 25 |
| 35 | $7 \times 10^4$ | 0.3 | — | — | — | — | — | 90 | 0.26 | 0.33 | 13 |

*from orifice
**Number of black spots

TABLE 5

| Dispersion pressure or number of revolutions | Dispersion cycle or time | * Fluid flow rate | Back pressure (kPa) | Average particle diameter (μm) | 0.5 μm or larger coarse particle percentage (%) |
|---|---|---|---|---|---|
| Example 45 | | | | | |
| $6 \times 10^4$ kPa: | Once | 350 m/sec | 0 | 0.20 | 5 |
| | Twice | " | " | 0.16 | 4 |
| | Three time | " | " | 0.14 | 3 |
| $1 \times 10^5$ kPa: | Once | 500 m/sec | $1 \times 10^3$ | 0.18 | 4 |
| | Twice | " | " | 0.14 | 3 |
| | Three times | " | " | 0.13 | 2 |
| $2 \times 10^5$ kPa: | Once | 700 m/sec | $2 \times 10^3$ | 0.16 | 3 |
| | Twice | " | " | 0.13 | 1 |
| | Three times | " | " | 0.13 | 1 |
| Comparative Example 38 | | | | | |
| $6 \times 10^4$ kPa: | Once | 350 m/sec | 0 | 0.24 | 13 |
| | Twice | " | " | 0.20 | 8 |
| | Three times | " | " | 0.20 | 8 |
| | Four times | " | " | 0.22 | 11 |
| | Five times | " | " | 0.24 | 11 |
| $1 \times 10^5$ kPa: | Once | 500 m/sec | 0 | 0.20 | 8 |
| | Twice | " | " | 0.20 | 7 |
| | Three times | " | " | 0.22 | 10 |
| | Four times | " | " | 0.24 | 11 |
| | Five times | " | " | 0.28 | 15 |
| Comparative Example 39 | | | | | |
| 500 rpm: | 30 minutes | — | — | 1.15 | 95 |
| | 60 minutes | — | — | 1.05 | 85 |
| | 120 minutes | — | — | 0.92 | 70 |
| 1,000 rpm: | 30 minutes | — | — | 0.90 | 68 |
| | 60 minutes | — | — | 0.82 | 60 |
| | 120 minutes | — | — | 0.75 | 55 |

TABLE 5-continued

| Dispersion pressure or number of revolutions | Dispersion cycle or time | * Fluid flow rate | Back pressure (kPa) | Average particle diameter (μm) | 0.5 μm or larger coarse particle percentage (%) |
|---|---|---|---|---|---|
| 2,000 rpm: | 30 minutes | — | — | 0.72 | 52 |
| | 60 minutes | — | — | 0.55 | 40 |
| | 120 minutes | — | — | 0.52 | 38 |

* Calculated from flow rate and orifice diameter

TABLE 6

| | Initial potential | | Potential after running | | Photo- | | |
|---|---|---|---|---|---|---|---|
| | Light area (V) | Resi-dual (V) | Light area (V) | Resi-dual (V) | sensitive member defects | Running scrape | Image evaluation |
| Example Photosensitive Member: | | | | | | | |
| 1 | −130 | −55 | −250 | −120 | No defects | 13 μm | Substantially good, but 1 or 2 microscopic line scratch mark(s). |
| 3 | −130 | −55 | −250 | −120 | No defects | 13 μm | Good images free of scratch marks. |
| 4 | −130 | −50 | −240 | −120 | No defects | 13 μm | Substantially good, but 1 or 2 microscopic line scratch mark(s). |
| 6 | −130 | −50 | −230 | −110 | No defects | 12 μm | Good images free of scratch marks. |
| 7 | −120 | −45 | −230 | −110 | No defects | 12 μm | Good images free of scratch marks. |
| 9 | −120 | −45 | −220 | −110 | No defects | 12 μm | Good images free of scratch marks. |
| Comparative Photosensitive Member: | | | | | | | |
| 1 | −130 | −55 | −270 | −140 | No defects | 14 μm | 8–10 line scratch marks on halftones. |
| 3 | −130 | −55 | −260 | −140 | No defects | 14 μm | 8–10 line scratch marks on halftones. |
| 5 | −130 | −55 | −260 | −130 | No defects | 13 μm | 6–8 line scratch marks on halftones. |
| 6 | −130 | −55 | −260 | −130 | No defects | 13 μm | 8–10 line scratch marks on halftones. |
| 8 | −130 | −55 | −250 | −120 | No defects | 13 μm | 6–8 line scratch marks on halftones. |
| 10 | −130 | −55 | −250 | −120 | No defects | 13 μm | 6–8 line scratch marks on halftones. |
| 11 | −170 | −75 | −290 | −160 | 15–20 aggl.* | 15 μm | Many peripheral-direction line scratch marks on halftones.(20 or more lines) |
| 13 | −150 | −70 | −290 | −160 | 15–20 aggl.* | 15 μm | Many peripheral-direction line scratch marks on halftones.(20 or more lines) |
| 14 | −150 | −75 | −290 | −160 | 15–20 aggl.* | 15 μm | Many peripheral-direction line scratch marks on halftones.(20 or more lines) |
| 16 | −150 | −70 | −280 | −155 | 10–15 aggl.* | 15 μm | Many peripheral-direction line scratch marks on halftones.(20 or more lines) |
| 17 | −150 | −65 | −280 | −160 | 10–15 aggl.* | 15 μm | Many peripheral-direction line scratch marks on halftones.(20 or more lines) |
| 19 | −140 | −65 | −280 | −150 | 5–10 aggl.* | 14 μm | Many peripheral-direction line scratch marks on halftones.(15–20 lines) |

*agglomerates of tetrafluoroethylene

TABLE 7

| | Initial stage halftone images | Halftone images after running |
|---|---|---|
| Example Photosensitive Member: | | |
| 10 | Very good images free of spots and scratch marks. | Very good images free of spots and scratch marks, but 1 or 2 microscopic line scratch mark(s). |
| 12 | Very good images free of spots and scratch marks. | Good images free of spots and scratch marks. |
| 13 | Very good images free of spots and scratch marks. | Good images free of spots and scratch marks. |
| 15 | Very good images free of spots and scratch marks. | Good images free of spots and scratch marks. |
| 16 | Very good images free of spots and scratch marks. | Good images free of spots and scratch marks. |
| 18 | Very good images free of spots and scratch marks. | Good images free of spots and scratch marks. |
| Comparative Photosensitive Member: | | |
| 20 | Uneven on the whole, and 5–10 black spots on images. | Good images free of spots and scratch marks. |
| 22 | 5–10 black spots on images. | 5–8 peripheral-direction line scratch marks ascribable to black spots. |
| 24 | 5–10 black spots on images. | 5–8 peripheral-direction line scratch marks ascribable to black spots. |
| 25 | Good. | 5–8 peripheral-direction line scratch marks ascribable to black spots. |
| 27 | Good. | 5–8 peripheral-direction line scratch marks ascribable to black spots. |
| 29 | Uneven on the whole, and 5–10 black spots on images. | 5–8 peripheral-direction line scratch marks ascribable to black spots. |
| 30 | Unevenness is conspicuous and 15–20 black spots on images. | 15 or more peripheral-direction line scratch marks ascribable to black spots. |
| 32 | Unevenness is conspicuous and 15–20 black spots on images. | 15 or more peripheral-direction line scratch marks ascribable to black spots. |
| 33 | Unevenness is conspicuous and 15–20 black spots on images. | 15 or more peripheral-direction line scratch marks ascribable to black spots. |
| 35 | Unevenness is conspicuous and 15–20 black spots on images. | 15 or more peripheral-direction line scratch marks ascribable to black spots. |
| 36 | Unevenness is conspicuous and 15–20 black spots on images. | 10 or more peripheral-direction line scratch marks ascribable to black spots. |
| 38 | Unevenness is conspicuous and 15–20 black spots on images. | 10 or more peripheral-direction line scratch marks ascribable to black spots. |

What is claimed is:

1. A process for producing an electrophotographic member having a layer on a conductive support comprising:

(a) ejecting a pressurized fluid in substantially an unatomized state from an orifice into a hollow member, said hollow member having a diameter (i) 10 mm or less and (ii) 3 to 50 times the diameter of the orifice, to form a dispersion of a material; and (b) coating said dispersion on said conductive support to form said layer.

2. A process according to claim 1, wherein a channel leading to said orifice is substantially straight.

3. A process according to claim 1, wherein said orifice has a diameter of from 0.01 mm to 1.0 mm.

4. A process according to claim 3, wherein the diameter of said orifice is from 0.05 mm to 0.3 mm.

5. A process according to claim 1, wherein said fluid is at a velocity of from 40 m/sec to 3,000 m/sec in said orifice.

6. A process according to claim 5, wherein the velocity of said fluid in said orifice is from 200 m/sec to 2,000 m/sec.

7. A process according to claim 1, wherein said hollow member has a length of from 30 mm to 300 mm.

8. A process according to claim 1, wherein said fluid is pressurized at a pressure of from $5\times10^3$ kPa to $3.2\times10^5$ kPa.

9. A process according to claim 8, wherein the pressure is from $2\times10^4$ kPa to $3\times10^5$ kPa.

10. A process according to claim 1, wherein said material to be dispersed is a phthalocyanine pigment.

11. A process according to claim 10, wherein said phthalocyanine pigment is oxytitanium phthalocyanine having a main peak at Bragg's angle ($2\theta\pm0.2°$) of 27.1° in CuKα characteristic X-ray diffraction.

12. A process according to claim 11, wherein said phthalocyanine pigment is oxytitanium phthalocyanine having strong peaks at Bragg's angles ($2\theta\pm0.2°$) of 9.0°, 14.2°, 23.9° and 27.1° in CuKα characteristic X-ray diffraction.

13. A process according to claim 1, wherein said material to be dispersed is an azo pigment.

14. A process according to claim 13, wherein said azo pigment is selected from the group consisting of compounds represented by the following formulas (1) to (5) and (6)

(1)
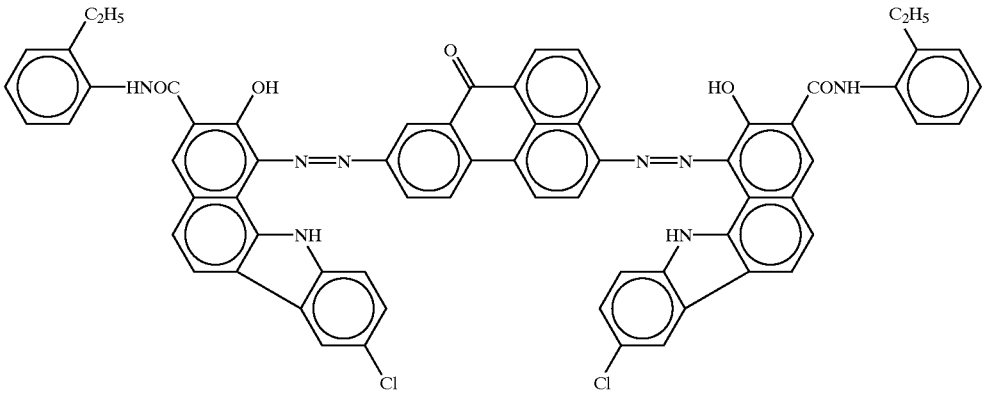
(2)
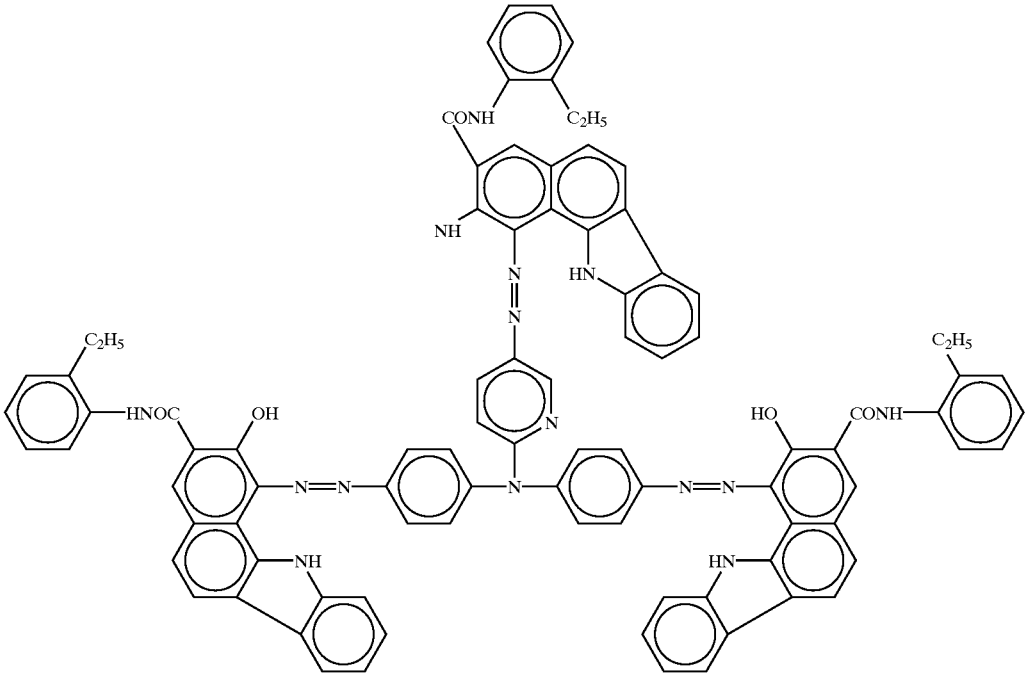
(3)
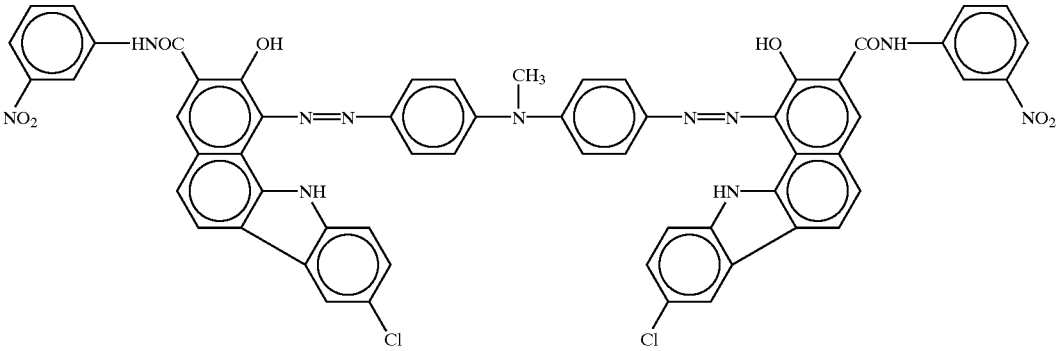

-continued
(4)
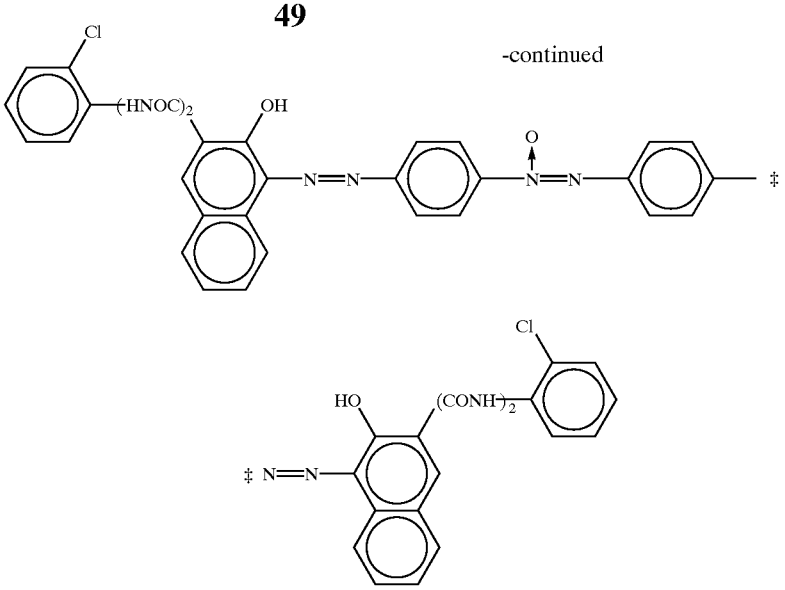
(5)
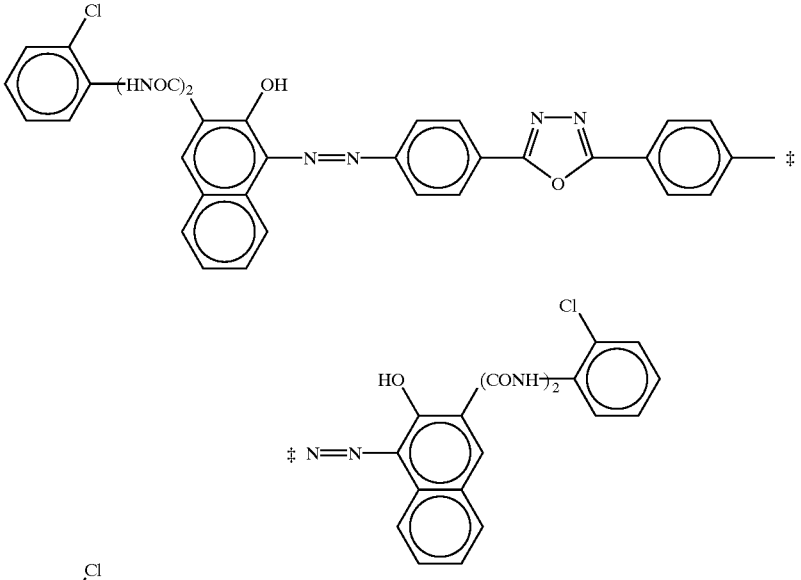
(6)
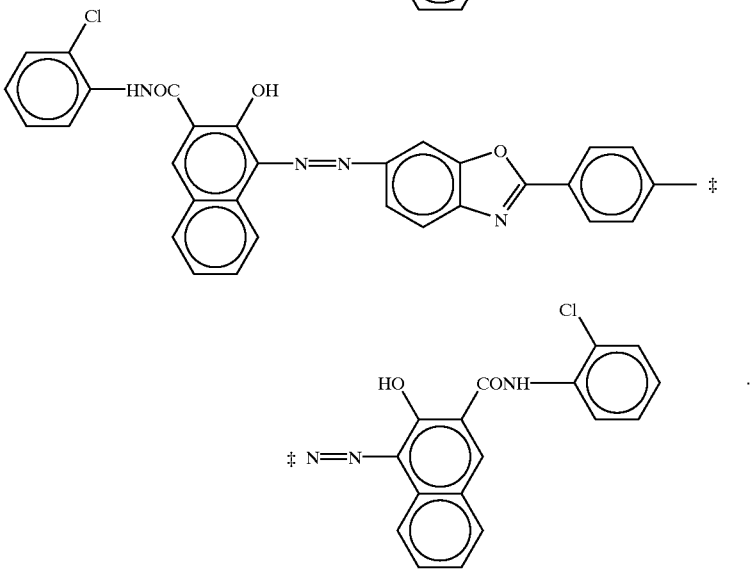

15. A process according to claim 1, wherein said material to be dispersed is a fluorine resin powder.

16. A process according to claim 1, wherein said pressurized fluid contains said material to be dispersed and a solvent.

17. A process according to claim 1, wherein said pressurized fluid contains a solvent and does not contain said material to be dispersed.

* * * * *

UNITED STATES PATENT AND TRADEMARK OFFICE

CERTIFICATE OF CORRECTION

PATENT NO. : 6,440,631 B1
DATED : August 27, 2002
INVENTOR(S) : Yoichi Kawamorita et al.

It is certified that error appears in the above-identified patent and that said Letters Patent is hereby corrected as shown below:

Title page,
Item [56], References Cited, OTHER PUBLICATIONS, "487 (-1286)" should read -- 487 (P-1286) --.

Drawings,
Sheet 4, Figs. 8 and 9, "INTENCITY" should read -- INTENSITY --.

Column 1,
Line 43, "tends" should read -- tend --;
Line 50, "fluid" should read -- fluids --; and
Line 65, "walls." should read -- walls --.

Column 2,
Line 6, "more" should read -- further --.

Column 3,
Line 37, "may" should read -- may have --.

Column 6,
Line 33, "unable" should read -- difficult --.

Column 13,
Line 39, "layer. As" should read -- layer, as --.

Column 14,
Line 52, "exchangeable). The" should read -- exchangeable). ¶ The --.

Column 17,
Line 9,

"

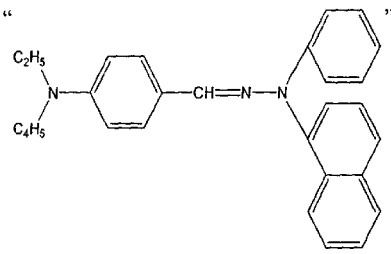

" should read

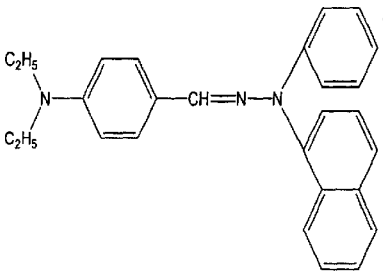

----; and

UNITED STATES PATENT AND TRADEMARK OFFICE

CERTIFICATE OF CORRECTION

PATENT NO. : 6,440,631 B1
DATED : August 27, 2002
INVENTOR(S) : Yoichi Kawamorita et al.

It is certified that error appears in the above-identified patent and that said Letters Patent is hereby corrected as shown below:

Column 17 cont'd,
Line 41, "K. K.)" should read -- K.K.) --.

Column 21,
Line 10, "well good" should read -- very good --; and
Line 11, "worn" should read -- worn down --.

Column 24,
Line 66, "member" should read -- members --.

Column 26,
Line 34, "worn" should read -- worn down --; and
Line 45, "can be made less occur" should read -- occur less --.

Column 32,
Lines 37 and 54, "worn" should read -- worn down --; and
Line 64, "images however" should read -- images; however, --.

Column 35,
Line 65, "methods Potential:" should read -- methods ¶ Potential: --.

Column 36,
Line 25,

"

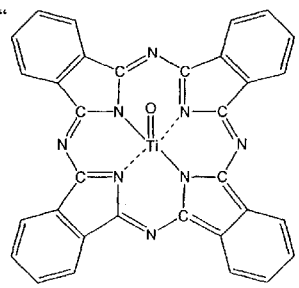

" should read

--

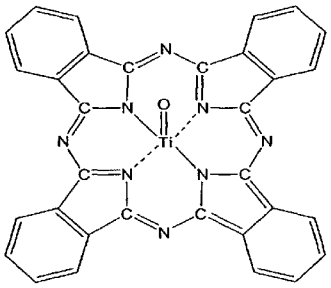

--; and

Line 66, "running on" should read -- running an --.

Column 40,
Table 4, " * should read -- * *

| | |
|---|---|
| Image evalua- tion " | Image evalua- tion --. |

UNITED STATES PATENT AND TRADEMARK OFFICE

CERTIFICATE OF CORRECTION

PATENT NO. : 6,440,631 B1 
DATED : August 27, 2002
INVENTOR(S) : Yoichi Kawamorita et al.

It is certified that error appears in the above-identified patent and that said Letters Patent is hereby corrected as shown below:

Column 41,
Table 5, "Once should read -- Once
Twice Twice
Three time" Three Times --.

Column 42,
Table 4, " * should read -- * *
Image Image
evalua- evalua-
tion " tion --.

Column 46,
Line 66, "formulas (1) to (5) and (6)" should read -- formulas (1) to (6) --.

Signed and Sealed this

First Day of April, 2003

JAMES E. ROGAN
*Director of the United States Patent and Trademark Office*